US007645013B2

(12) United States Patent
Murakami et al.

(10) Patent No.: US 7,645,013 B2
(45) Date of Patent: Jan. 12, 2010

(54) IMAGE RECORDING APPARATUS

(75) Inventors: Atsushi Murakami, Ebina (JP); Akira Mihara, Ebina (JP); Hiroaki Satoh, Ebina (JP); Masami Furuya, Ebina (JP); Kishiharu Itazu, Ebina (JP); Hiroshi Ikeda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 234 days.

(21) Appl. No.: 11/057,942

(22) Filed: Feb. 15, 2005

(65) Prior Publication Data

US 2006/0050099 A1 Mar. 9, 2006

(30) Foreign Application Priority Data

Sep. 8, 2004 (JP) ..... 2004-261256

(51) Int. Cl.
*B41J 29/393* (2006.01)
*B41J 2/385* (2006.01)
*G03G 15/01* (2006.01)

(52) U.S. Cl. ..... 347/19; 347/116; 399/301

(58) Field of Classification Search ..... 347/4, 347/9, 14, 116, 12, 19, 5, 15, 16; 399/49, 399/66, 301

See application file for complete search history.

(56) References Cited

U.S. PATENT DOCUMENTS 5,160,946 A * 11/1992 Hwang ..... 347/116
5,381,167 A * 1/1995 Fujii et al. ..... 347/116
6,578,945 B2 * 6/2003 Hashi et al. ..... 347/22
6,817,692 B2 * 11/2004 Nakazawa et al. ..... 347/12
6,836,277 B2 * 12/2004 Tajima ..... 347/232
6,909,516 B1 * 6/2005 Hoover ..... 356/615
6,942,308 B2 * 9/2005 Molinet et al. ..... 347/4
7,021,738 B2 * 4/2006 Juan et al. ..... 347/19
7,123,852 B2 * 10/2006 Tomizawa ..... 399/49
2003/0136646 A1 * 7/2003 Powell ..... 198/807
2005/0052488 A1 * 3/2005 Inoue ..... 347/19

FOREIGN PATENT DOCUMENTS

JP 8-152917 6/1996
JP 2002062709 A * 2/2002
JP 2002-248744 9/2002

* cited by examiner

*Primary Examiner*—Hai C Pham
(74) *Attorney, Agent, or Firm*—Fildes & Outland, P.C.

(57) ABSTRACT

In an image recording apparatus, reference patterns are provided on a surface of a transport belt that transports a recording medium such as paper attracted thereto to image recording sections defined by recording heads. It is arranged such that the reference patterns are detected while being transported as the transport belt is driven, and a speed change of the transport belt and a position shift in a direction perpendicular to the transporting direction of the transport belt are calculated based on information resulting from the detection, thereby controlling ejection timing and ejection position of ink droplets ejected from the recording heads.

13 Claims, 17 Drawing Sheets

IMAGE RECORDING APPARATUS

Cross-Reference claims priority under 35 USC 119 from Japanese Patent Application No. 2004-261256, the disclosure of which is incorporated by reference herein.

BACKGROUND OF THE INVENTION

1. Field of the Invention

The present invention relates to an image recording apparatus, and more particularly it pertains to an image recording apparatus wherein an image is recorded on a recording medium supported on and transported by a transport member, by ejecting ink droplets from plural ink ejection ports provided in recording heads.

2. Description of the Related Art

In an image recording apparatus of the inkjet type in which an image is recorded on paper (recording medium) by ejecting ink droplets from recording heads, a printing system called a serial scan system is widely used primarily for personal use, wherein the paper is transported and printing is performed on a line-by-line basis by reciprocally moving recording heads in a direction perpendicular to the transporting direction of the paper. In recent years, a so-called full-line head type image recording apparatus adapted for office use as well has come to be manufactured wherein image recording is performed by continuously transporting paper and using a paper-width size, non-scan type recording head having a multiplicity of ink ejection ports (nozzles) arrayed along a direction (widthwise direction) perpendicular to the transporting direction of the paper, thereby achieving an increased printing speed.

Among the above image recording apparatuses is one in which either a transport belt for transporting paper attracted thereto or a roller about which the transport belt is entrained is provided with a rectilinear (one-dimensional) scale extending along the direction of rotational movement (paper transporting direction) of the transport belt or the direction or rotation of the roller, and a drive motor is controlled based on a measurement amount obtained by measuring the speed and movement amount of the scale by means of a sensor, thereby increasing transport and positioning accuracy (for example, refer to JP-A No. 8-152917). Further, among the above image recording apparatuses are ones in which a recording shift in the paper transporting direction due to a mounting position shift between plural line heads is corrected by adjusting the output timing of a recording signal on an each line head basis (for example, refer to JP-A No. 2002-248744), and one in which plural pixel blocks in image data are realigned according to the inclinations of line heads so that the inclinations of the line heads are corrected (influence of mounting error is reduced), thereby facilitating registration control when plural line heads are used (for example, refer to JP-A No. 2001-30478).

However, in the above image recording apparatuses, the position of the paper is shifted from an ideal position or a predicted position for the recording head due to a position shift (speed change) in the transporting direction of the transport belt for transporting the paper attracted and attached thereto or a position shift (skew/walk(meandering)) in a direction perpendicular to the transporting direction so that shading and/or distortion is caused to occur in the image, which leads to a decrease in image quality. Regarding such decrease in image quality due to speed change and/or skew/walk, techniques disclosed in the above Japanese patents prevent a decease in image quality due to speed change, but cannot prevent a decrease in image quality due to skew/walk.

Further, with a system in which paper is transported by being attracted and attached to a conventional transport belt, since the orientation of the paper attracted to the transport belt is not detected, it is very likely that recording is performed outside the paper, or on the transport belt when the paper is inappropriately attracted to the transport belt such as when the paper is obliquely attracted and attached to the transport belt, so that such problems arise as ink contamination inside the apparatus and useless ink consumption.

SUMMARY OF THE INVENTION

In view of what has been discussed above, the present invention provides an image recording apparatus which is designed such that decrease in image quality due to a speed change of the transport member for transporting a recording medium and a decrease due to a position shift a direction perpendicular to the transporting direction of the transport member can be prevented so that high-quality image recording can be achieved. Further, the present invention provides an image recording apparatus which is designed such that it is possible to prevent ink contamination inside the apparatus and useless ink consumption which tends to be caused when a recording medium is inappropriately attracted to a transport member.

A first aspect of the present invention provides an image recording apparatus wherein an image is recorded on a recording medium being transported, by ejecting ink droplets from plural ink ejection ports provided in a recording head, the apparatus comprising: a transport member for transporting a recording medium supported on a surface thereof to an image forming position defined by the recording head; a drive unit that drives the transport member in a transporting direction of the recording medium; a reference pattern provided on the surface of the transport member; a detecting unit that detects the reference pattern being moved as the transport member is driven; a calculating unit that calculates a speed change of the transport member and a position shift in a direction perpendicular to the transporting direction of the transport member based on detection information from the detecting unit; and an ink ejection control unit that controls output timing of ink droplets ejected from the plural ink ejection ports so as to correct for the influence of the speed change of the transport member based on a result of the calculation of the speed change of the transport member by the calculating unit and controls ejection positions of the ink droplets ejected from the plural ink ejection ports so as to correct for the influence of the position shift in the direction perpendicular to the transporting direction of the transport member based on a result of the calculation of the position shift in the direction perpendicular to the transporting direction of the transport member by the calculating unit.

A second aspect of the present invention provides an image recording apparatus wherein an image is recorded on a recording medium being transported, by ejecting ink droplets from plural ink ejection ports provided in a recording head, the apparatus comprising: a transport member for transporting a recording medium supported on a surface thereof to an image forming position defined by the recording head; a drive unit that drives the transport member in a transporting direction of the recording medium; a reference pattern provided on the surface of the transport member; a detecting unit that detects the reference pattern being moved as the transport member is driven; a calculating unit that calculates a speed change of the transport member and a position shift in a direction perpendicular to the transporting direction of the transport member based on detection information of the detecting unit; a transport member drive control unit that controls the drive unit so as to suppress the speed change of the recording medium based on a result of the calculation of the speed change of the transport member by the calculating unit; a correcting unit that corrects the position shift in the direction perpendicular to the transporting direction of the transport member which occurs as the transport member is driven; and a transport member correction control unit that controls the correcting unit so as to suppress the position shift in the direction perpendicular to the transporting direction of the transport member based on a result of the calculation of the position shift by the calculating unit.

A third aspect of the present invention provides an image recording apparatus wherein an image is recorded on a recording medium being transported, by ejecting ink droplets from plural ink ejection ports provided in a recording head, the apparatus comprising: a transport member for transporting a recording medium supported on a surface thereof to an image forming position defined by the recording head; a drive unit that drives the transport member in a transporting direction of the recording medium; a reference pattern provided on the surface of the transport member; a detecting unit that detects the reference pattern being moved as the transport member is driven; a calculating unit that calculates a speed change of the transport member and a position shift in a direction perpendicular to the transporting direction of the transport member based on detection information from the detecting unit; a memory unit that stores a result of the calculation by the calculating unit; an ink ejection control unit that controls output timing of ink droplets ejected from the plural ink ejection ports so as to correct for the influence of the speed change of the transport member based on a result of the calculation of the speed change of the transport member by the calculating unit and controls ejection positions of the ink droplets ejected from the plural ink ejection ports so as to correct for the influence of the position shift in the direction perpendicular to the transporting direction of the transport member based on a result of the calculation of the position shift in the direction perpendicular to the transporting direction of the transport member by the calculating unit; a transport member drive control unit that controls the drive unit so as to suppress the speed change of the recording medium based on a result of the calculation of the speed change of the transport member by the calculating unit; a correcting unit that corrects the position shift in the direction perpendicular to the transporting direction of the transport member which occurs as the transport member is driven; and a transport member correction control unit that controls the correcting unit so as to suppress the position shift in the direction perpendicular to the transporting direction of the transport member based on a result of the calculation of the position shift by the calculating unit.

Other object, features and advantages of the present invention will become apparent to a person having ordinary skill in the art from the following description taken in conjunction with the accompanying drawings.

BRIEF DESCRIPTION OF THE DRAWINGS

Preferred embodiments of the present invention will be described in detail based on the following figures, wherein.

DETAILED DESCRIPTION OF THE INVENTION

The image recording apparatus embodying the present invention will now be described in detail with reference to the drawings.

First Embodiment

Figure 1:
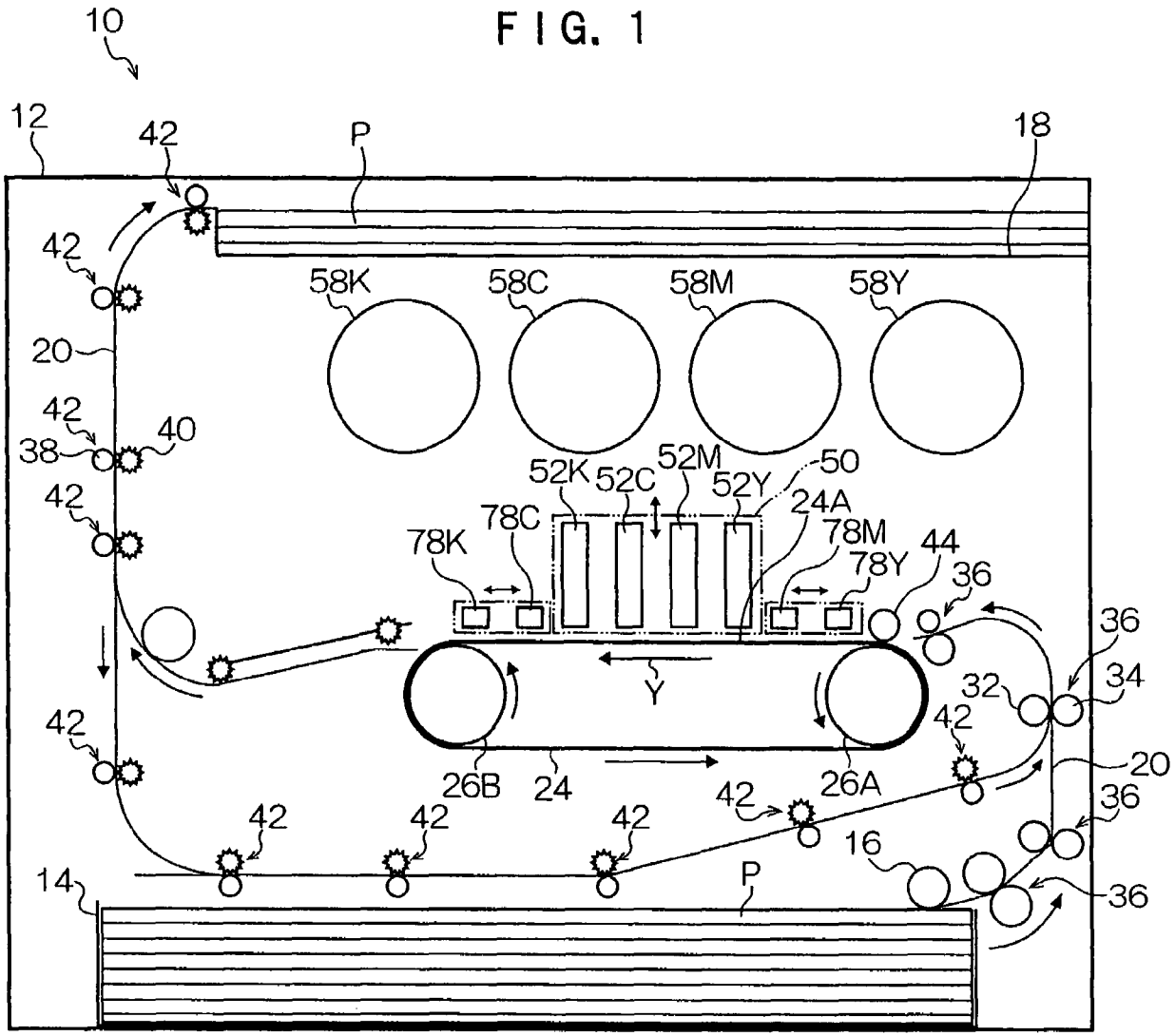
FIG. 1 is a diagrammatical view showing the structure of an image recording apparatus according to a first embodiment of the present invention.

As shown in FIG. 1, an image recording apparatus (inkjet recording apparatus) 10 according to a first embodiment of the present invention includes an image recording apparatus body 12 in which a paper feed tray 14 storing stacked sheets of paper P is disposed on the bottom thereof.

Above the fore end of the paper feed tray 14 is provided a pick-up roller 16 which is disposed in pressure contact with the fore end portion of the upper surface of the top sheet of paper P upwardly biased by means of a load plate (not shown) accommodated in the paper feed tray 14. The pick-up roller is adapted to be rotated to a predetermined extent by a printing operation of the image recording apparatus 10, and to thus feed the top sheet of paper P from inside the paper feed tray 14.

Further, above the paper feed tray 14 is provided a transport path 20 which is extended, while being curved in approximately an S shape, upwardly from a position adjacent to the fore end portion of the paper feed tray 14 (where the pick-up roller 16 is disposed in pressure contact with paper P) to a paper exhaust tray or catch tray 18 provided at the top of the image recording apparatus body 12.

Figure 3:
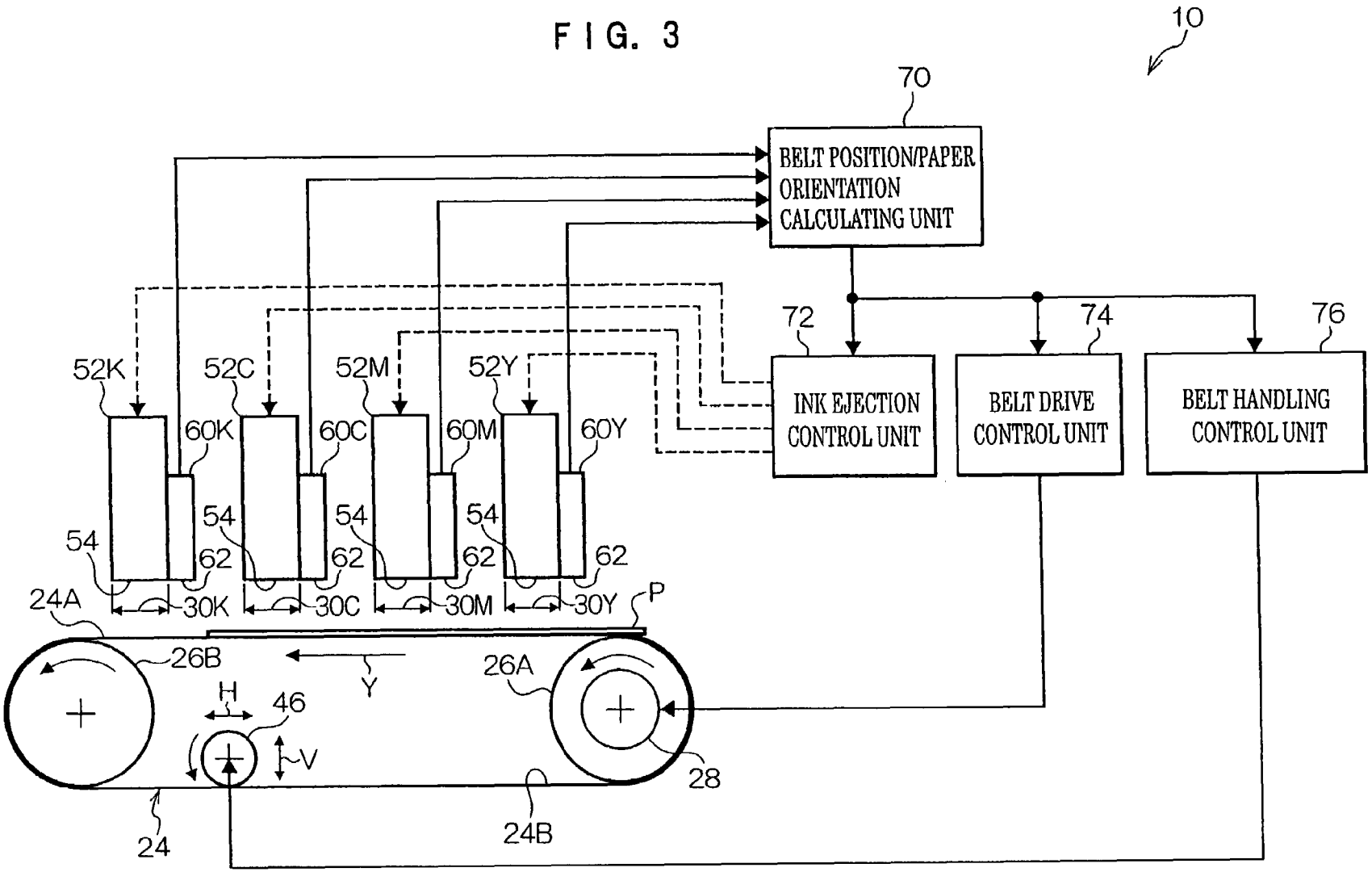
FIG. 3 is a diagrammatical view showing a major portion of the image recording apparatus according to the first embodiment of the present invention.

The transport path 20 is separated in the vicinity of the center of the image recording apparatus body 12. In the separated portion of the transport path 20, an endless transport belt 24 is extended substantially horizontally, and entrained about two cylindrical rollers 26A and 26B which are disposed substantially horizontally and in predetermined spaced relationship with each other. As shown in FIG. 3, the roller 26A located on an upstream side in the transporting direction of the paper P (on the right side as viewed in FIG. 3) is driven to be rotated by a drive motor 28, thereby causing the endless transport belt 24 to be moved while being rotated in a predetermined direction (anti-clockwise in FIGS. 1 and 3).

Figure 4:
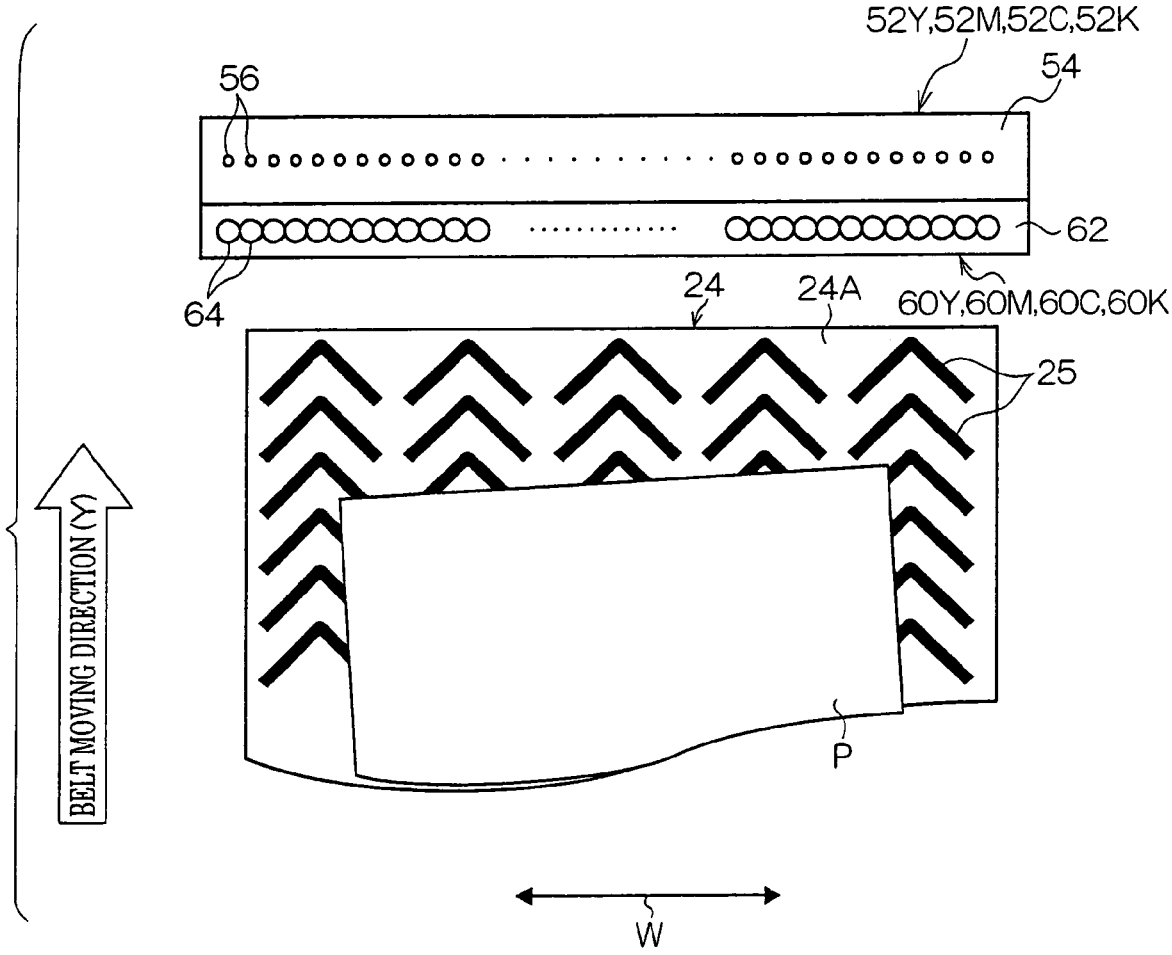
FIG. 4 is a plan view showing the positional relationships between the transport belt, recording heads, and reference pattern detecting sensors according to the first embodiment of the present invention.

The transport belt 24 has a plurality of reference patterns 25 formed on its surface 24A, as shown in FIG. 4. In this embodiment, each of the reference patterns 25 is formed as a chevron pattern which appears inverted V-shaped when the surface 24A is viewed with the moving direction of the transport belt 24 directed upward, and the transport belt 25 is colored to be in high contrast (for example, a combination such that the transport belt 24 is white and the reference patterns are black). Further, the respective reference patterns 25 are provided on substantially the entire surface 24A of the transport belt 24 and arranged, in the form of a matrix, in the direction of the rotational movement of the transport belt 24 and in a widthwise direction (direction indicated by arrows W in FIG. 4) perpendicular to the direction of the rotational movement at predetermined intervals.

As shown in FIG. 1, a charging roller 44 is provided at a location above the upstream portion of the transport belt 24. The charging roller 44 is disposed in parallel relationship with the roller 26*a* and in pressure contact with the surface 24A of the transport belt 24. The paper P fed from the paper feed tray 14 and transported along the transport path 20 to the position where the charging roller 44 is disposed in pressure contact with the transport belt, is pressed against the transport belt 24 by the charging roller 44 which is rotated in response to the rotational movement of the transport belt 24, and charged by the charging roller. Thus, the paper P is attracted to the surface (outer peripheral surface) 24A of the transport belt 24 due to a resultant electrostatic force of attraction, and transported in a direction indicated by an arrow Y in response to the rotational movement of the transport belt 24.

As shown in FIG. 3, a belt handling roller 46 which is cylindrical in shape and has a smaller diameter than the rollers 26A and 26B is provided in the vicinity of the roller 26B provided on a downstream side of the transporting direction of the paper P (on the left side as viewed in FIG. 3). The belt handling roller 46 is disposed in pressure contact with the lower inner peripheral surface 24B of the transport belt 24 over the entire widthwise direction (the direction perpendicular to the paper surface in FIG. 3) of the transport belt 24, and rotated in response to the rotational movement of the transport belt 24. Further, the belt handling roller 46 is arranged to be moved by a roller moving mechanism (not shown) so as to undergo an orientation change such that its axis is tilted either in a vertical direction (in a direction indicated by arrows V in FIG. 3) or in a horizontal direction (in a direction indicated by arrows H in FIG. 3).

When the belt handling roller 46 undergoes an orientation change in the vertical direction, the pressing force acting on the transport belt 24 is changed in the direction of the belt width so that the tension of the transport belt is also changed in the direction of the belt width. On the other hand, when the belt handling roller 46 undergoes an orientation change in the horizontal direction, a lap position where the transport belt 24 is lapped onto the belt handling roller 46 is shifted in the direction of the belt's width so that the pressing portion of the transport belt 24 against the belt handling roller 46 is also changed in the direction of the belt's width. Thus, the transport belt 24, when moved while being rotated, is shifted in a direction (direction indicated by arrows W in FIG. 4) perpendicular to the direction of the rotational movement (in the transporting direction of the paper P), and thus changed in position.

As shown in FIG. 1, a recording head unit 50 is provided above the transport belt 24 in opposing relationship with the surface 24A of the flattened transport belt 24. The recording head unit 50 is driven by a lift mechanism (not shown) so as to be moved between a lowered position shown in FIGS. 1 and 3 and a raised position shown in FIG. 2. The recording head unit 50 comprises recording heads 52Y, 52M, 52C, and 52K arranged along the direction of the rotational movement of the transport belt 24, the heads 52Y, 52M, 52C, and 52K being adapted for ejecting, with predetermined timings, ink droplets of four colors yellow (Y), magenta (M), cyan (C) and black (K) onto the paper P transported by the transport belt 24, in the named order as viewed from the upstream side of the direction of the rotational movement of the transport belt 24 (the transporting direction of the paper P), thereby forming a color image on the paper P.

The image recording apparatus body 12 includes ink tanks 58Y, 58M, 58C and 58K for storing inks of four colors yellow, magenta, cyan and black from which inks are supplied to the recording heads 52Y-52K through pipes (not shown), respectively.

As shown in FIG. 4, each of the color recording heads 52Y-52K is configured in the form of an elongated, non-scan type line head which extends along the widthwise direction (the direction indicated by the arrows W) perpendicular to the direction of the rotational movement of the transport belt 24 and has a slightly greater length than the widthwise dimension of the transport belt 24. Each of the color recording heads 52Y-52K has a nozzle forming surface 54 in which a plurality of nozzles 56 are arranged with a predetermined interval along the widthwise direction of the head and in such a manner as to define an effective printing width equal to or greater than the width of the paper P to be transported by the transport belt 24.

Each of the color recording heads 52Y-52K is positioned such that its nozzle forming surface 54 in which the plurality of nozzles 56 for ejecting ink droplets are formed is directed toward the surface 24A of the transport belt 24. They are also arranged such that the nozzle forming surface 54 of each color recording head is spaced by a predetermined distance from the surface 24A of the transport belt 24 when each color recording head assumes the lowered position shown in FIGS. 1 and 3. Further, it is arranged such that the spaces between the respective color recording heads 52Y-52K and the transport belt 24 serve as image recording portions (image recording locations) 30Y, 30M, 30C, and 30K, respectively, where the respective color recording heads 52Y-52K are permitted to eject ink droplets from their nozzles 56 so as to record an image on the paper P which is attracted and attached to the surface 24A of the transport belt 24 and is transported from the upstream side to the downstream side of the transporting direction in accordance with the rotational movement of the transport belt 24 (see FIG. 3).

As shown in FIGS. 3 and 4, the respective color recording heads 52Y, 52M, 52C, and 52K are provided with reference pattern detecting sensors (optical sensors) 60Y, 60M, 60C and 60K which are positioned adjacent thereto on the upstream side in the transporting direction of the paper P, respectively.

Each of the reference pattern detecting sensors 60Y-60K provided in association with the respective color recording heads 52Y-52K is configured in the form of an elongated line sensor having a width substantially equal to that of each recording head 52Y-52K, as shown in FIG. 4. Each of the reference pattern detecting sensors 60Y-60K has a sensor surface 62 directed in the same direction as the nozzle forming surface 54 of each recording head 52Y-52K (toward the surface 24A side of the transport belt 24) (see FIG. 3). On the sensor surface 62 of each reference pattern detecting sensor 60Y-60K, a plurality of optical sensors (light emitting/receiving elements) 64 are arranged along the widthwise direction of the reference pattern detecting sensor with a predetermined spacing, wherein the range of detection by the plurality of optical sensors 64 is set to be wider than the width of the transport belt 24.

Description will now be made of an example of the reference pattern 25 to be provided on the transport belt in this embodiment.

Assuming that the transporting speed of the transport belt 24 is Vb, that the sampling time of a control unit is Ts, and that the resolution of reference pattern detecting sensor 60Y-60K for detecting the reference patterns 25 is Ds, the length L1 of the peak portion and the length L2 of the valley portion of each reference pattern meet the following conditions:

$$L1, L2 \geqq 2 \times Vb \times Ts$$

$$L1, L2 \geqq 2 \times Ds$$

Further, the width Wp and the spacing Gp of each reference pattern 25 meets the following relations:

$$Wp \geqq 2 \times 3 \times Ds$$

$$Gp \geqq 2 \times Ds$$

Figure 5A:
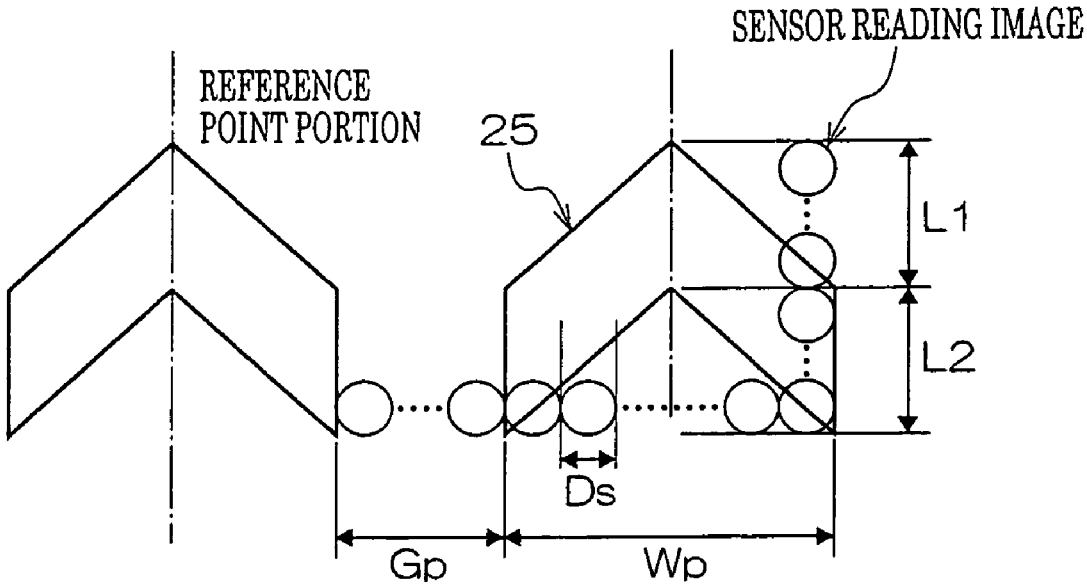
FIG. 5A and FIG. 5B are plan views illustrating the reference patterns according to the first embodiment of the present invention, respectively.
Figure 5B:
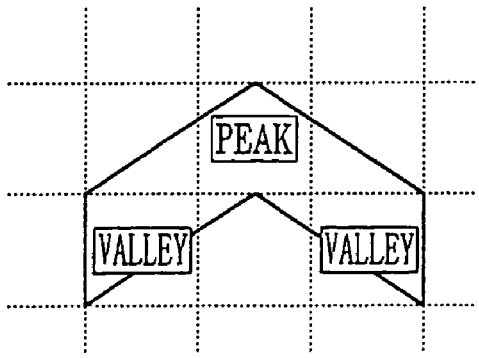

In order to determine the peak and valley portions of the reference pattern 25, as shown in FIG. 5B, with respect to the lengthwise direction (moving direction) of the pattern, two values for the peak and valley portions should be used for resolution and thus L1 and L2 are used as the conditions for resolution. With respect to the lateral direction (widthwise direction), at least three values should be used for resolution and thus the constant 3 is included in the relational expression for Wp Further, in order to sufficiently resolve the reference patterns 25 by means of the reference pattern detecting sensors 60Y-60K, it is required that the reference patterns 25 be more than two times as large as the sensor resolution, and thus the constant 2 is contained in all the above relational expressions.

Let it now be assumed that the transporting speed Vb of the transport belt 24 is 762 mm/sec (corresponding to an injection rate of 600 dpi/18 kHz), that the sampling time Ts of the control unit is 20 msec, and that the resolving power of the reference pattern detecting sensor 60Y-60K is 42.3 μm (corresponding to 600 dpi). Then, the sizes of the respective portions of the reference pattern 25 shown in FIG. 5 can be sought from the above relational expressions as follows:

$$L1, L2 \geqq 15.2 \text{ mm}$$

$$Wp \geqq 253.8 \text{ mm}$$

$$Gp \geqq 84.6 \text{ mm}$$

In practice, however, taking into account the safety factor for pattern detection and ease forming the patterns, the actual reference patterns 25 are set as follows:

$$L1 = L2 = 20 \text{ mm}$$

$$Wp = 10 \text{ mm}$$

$$Gp = 2 \text{ mm}$$

As shown in FIG. 3, the reference pattern detecting sensors 60Y-60K are connected to a calculating unit 70 for calculating the position of the transport belt 24 and the orientation (tilt) of the paper P transported by the transport belt 24. Thus, detection signals outputted from the respective reference pattern detecting sensors 60Y-60K are inputted to the calculating unit 70.

Also connected to the calculating unit are an ink ejection control unit 72 for controlling ejection timing and ejection position of an ink droplet ejected from each nozzle 56 of each recording head 52Y-52K, a belt drive control unit 74 for controlling the motor 28 for driving the transport belt 24, and a belt handling control unit 76 for controlling a roller moving mechanism (not shown) for moving the belt handling roller 46.

As shown in FIG. 1, above the transport belt 24, maintenance units 78Y and 78M associated with the recording heads 52Y and 52M are provided on the upstream side of the recording head unit 50 in the paper transporting direction, and maintenance units 78C and 78K associated with the recording heads 52C and 52K are provided on the downstream side of the recording head unit 50 in the paper transporting direction.

Each of the maintenance units 78Y-78K is provided with a dummy jet receiving member for receiving ink droplets ejected from the nozzles 56 when the recording heads 52Y-52K performs dummy jet, a wiping member for cleaning the nozzle forming surfaces 54 of the recording heads 52Y-52K, a cap fitted in close contact with the nozzle forming surfaces 54 of the recording heads 52Y-52K so as to seal the nozzles 56 thereby preventing the nozzles 56 from being dried, and so forth.

Figure 2:
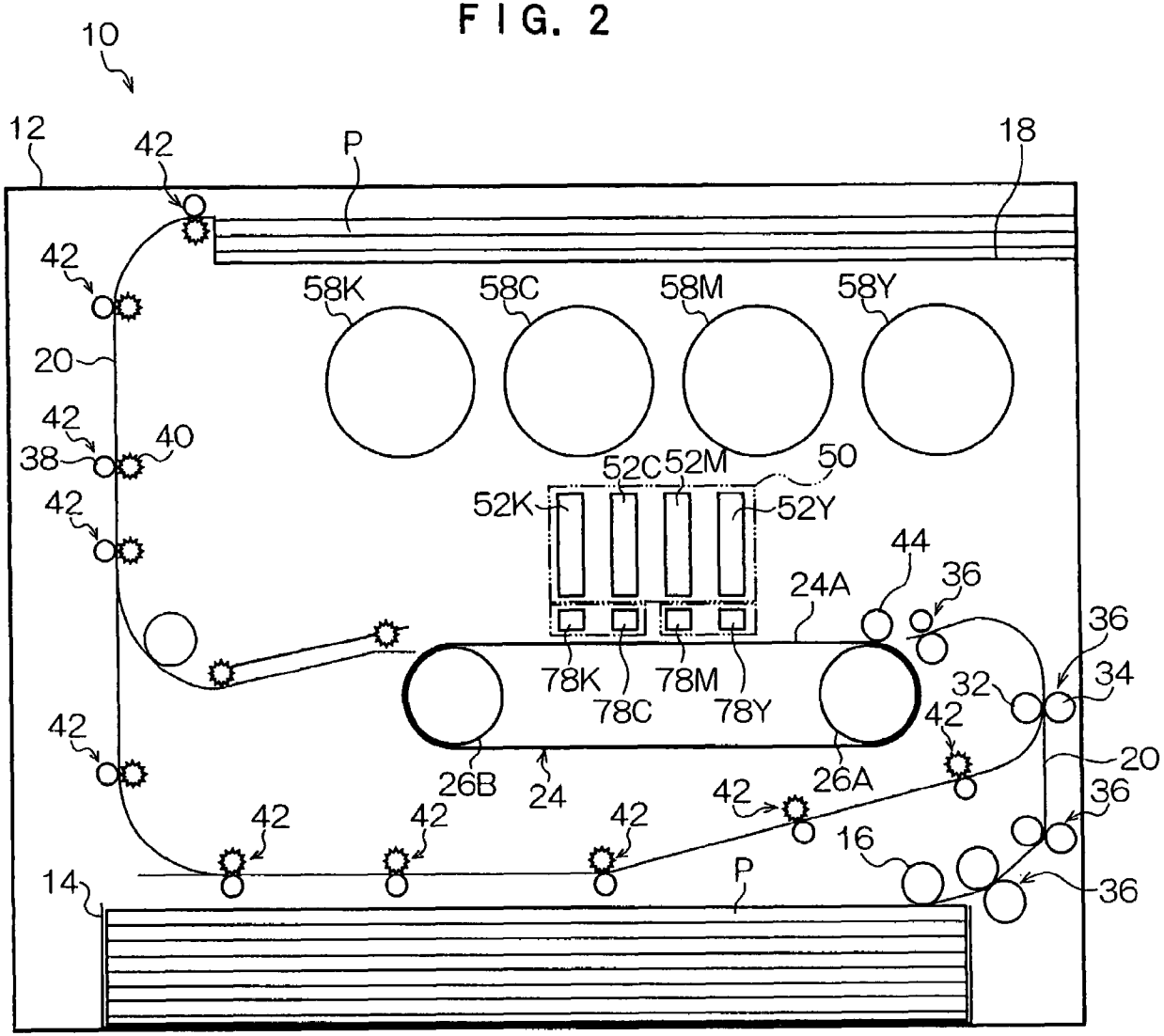
FIG. 2 is a diagrammatical view showing the image recording apparatus of FIG. 1 when it is in a maintenance state.

The maintenance units 78Y, 78M and 78C, 78K are moved in substantially a horizontal direction by moving mechanisms (not shown). When the recording head unit 50 is lowered (during a printing operation) as shown in FIG. 1, the maintenance units 78Y, 78M and 78C, 78K are located at the sides of the recording head unit 50 adjacent thereto, while when the recording head unit 50 is raised (during a maintenance operation) as shown in FIG. 2, the maintenance units 78Y, 78M and 78C, 78K are moved to positions below the recording head unit 50 and disposed in opposing relationship to the nozzle forming surfaces 54 of the associated recording heads 52Y-52K respectively.

Between the transport belt 24 and the paper feed tray 14 is provided a reverse transport path 22 which is connected to the transport path 20 and configured so as to reverse an image-formed paper P transported by the transport belt 24 and discharged to a downstream side of the transport path 20 and permit the reversed paper P to be transported into the image recording portions 30Y, 30M, 30C, and 30K again for a double-side printing purpose.

A plurality of transport roller pairs 36 each comprising cylindrical transport rollers 32, 34 are provided in the transport path 20 upstream of the transport belt 24 in the paper transporting direction. Upstream of the transport belt 24 in the transport path 20, a paper P fed from the paper feed tray 14 by the pick-up roller 16 is transported along the transport path 20 to the transport belt 24 and then fed between the charging roller 44 and the transport belt 24 by means of the plurality of transport roller pairs 36.

Downstream of the transport belt 24 in the transport path 20, and in the reverse transport path 22, a plurality of transport roller pairs 42 are provided each of which comprises an cylindrical elastic roller 38 having an outer layer formed of an elastic material such as rubber and a spur roller 40 having axially extending inverted V-shaped projections provided on the outer peripheral surface thereof, the projections being arranged continuously along the outer peripheral surface and provided on the surfaces thereof with a liquid-repellent coating layer in the form of a film. Downstream of the transport belt 24 in the transport path 20, an image-formed paper P is transported along the transport path 20 to the top of the image forming apparatus body 12 and discharged to the catch tray 18. Further, when performing double-side printing, a paper P having an image formed on one side is switched back at a downstream side of the transport path 20 and guided to the reverse transport path 22. Then the paper P is transported by the transport roller pairs 42, reversed or turned up side down, and returned to an upstream side of the transport path 20.

Description will next be made of a printing operation (color image recording operation) performed by the image recording apparatus 10 constructed as mentioned above according to this embodiment.

In the image recording apparatus 10, when the apparatus is operated, the recording head unit 50 is located at the lowered position shown in FIG. 1, and when a printing operation is started in accordance with a print job inputted, the drive motor 28 is rotationally driven so as to cause the transport belt 24 to be rotationally moved, and at the same time the pick-up roller 16 is rotated to a predetermined extent in a predetermined direction to feed the top sheet of paper P from a stack of sheets of paper accommodated in the paper feed tray 14 and feed it out to the transport path 20. The paper P fed is transported to the upstream side of the transport belt 24, and then fed into between the transport belt 24 and the charging roller 44.

At this point, the paper P is pressed against the transport belt 24 and charged by the charging roller 44 so as to be attracted and attached to the surface 24A of the transfer belt 24 due to an electrostatic force of attraction and transported in the direction indicated by the arrow Y in accordance with the rotational movement of the transport belt 24.

The recording heads 52Y-52K of the recording head unit 50 and the reference pattern detecting sensors 60Y-60K are operated in synchronism with the paper P being transported in accordance with the rotational movement of the transport belt 24, so that the reference pattern detecting sensors 60Y-60K detect the reference patterns 25 provided on the transport belt 24 and the recording heads 52Y-52K eject inks supplied from the ink tanks 58Y-58K, from the nozzles 56 with predetermined timings.

When the paper P transported by the transport belt 24 passes through the image recording portions 30Y-30K, ink droplets of the respective colors such as yellow, magenta, cyan, and black are caused to land on a surface of the paper P, and images of the respective colors which are formed by these ink droplets are superimposed upon each other, thus resulting in a color image being recorded on the surface of the paper P.

Description will now be made of a process of detection of the reference patterns 25 by the reference pattern detecting sensors 60Y-60K, a method for preventing an decrease in image quality due to a speed change and/or skew/walk of the transport belt 24 based on information obtained through the pattern detection, and a method for preventing ink contamination inside the image recording apparatus 10 and useless ink consumption which tend to be caused when the paper P is not appropriately attracted and attached to the transport belt 24.

Figure 6:
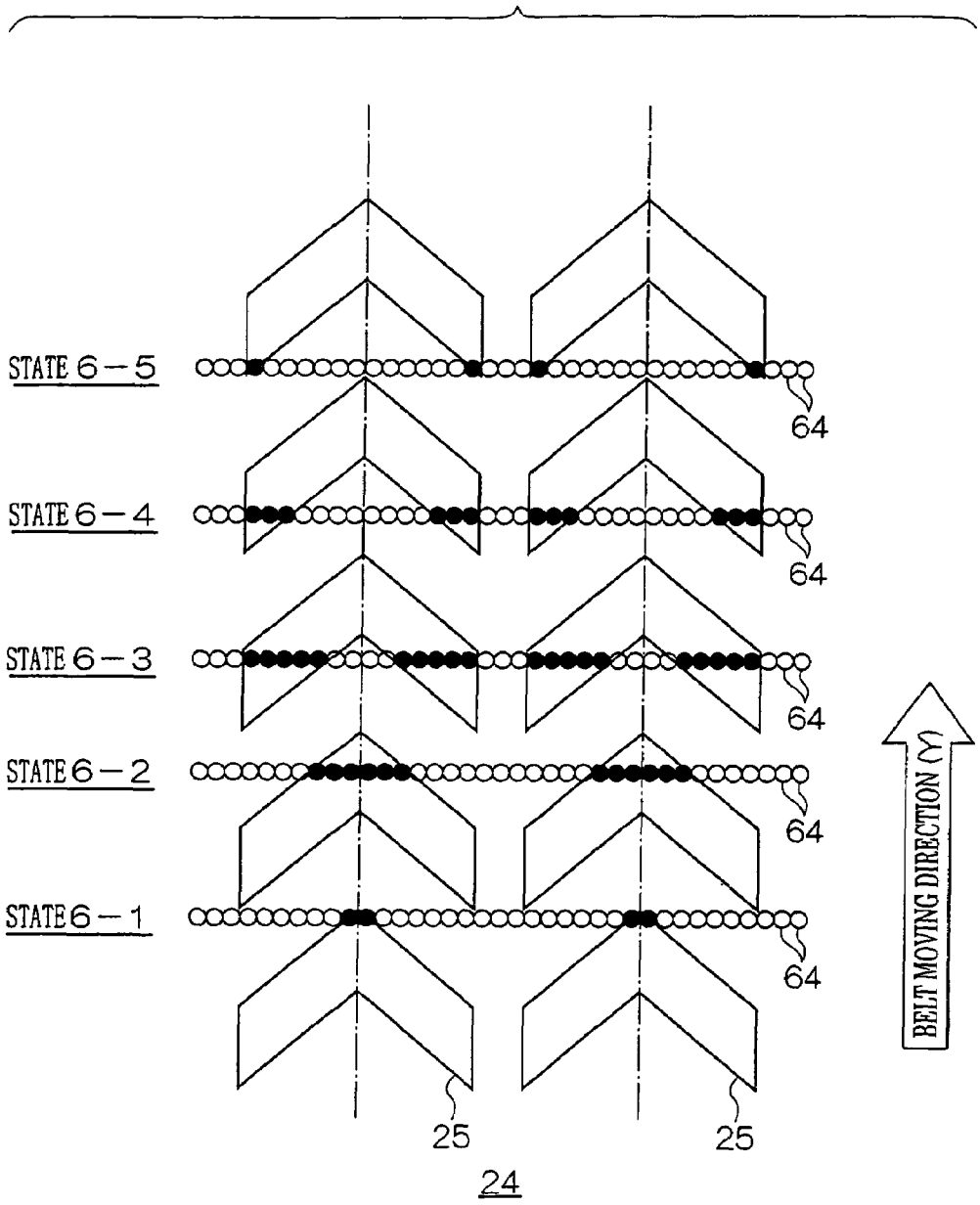
FIG. 6 is a view useful for explaining a process for detecting the reference patterns of the transport belt by means of the reference pattern detecting sensors according to the first embodiment of the present invention.

FIG. 6 diagrammatically shows, in five stages (states 6-1 to 6-5), a process in which the reference patterns 25 are detected by the respective optical sensors 64 of the reference pattern detecting sensors 60Y-60K when the reference patterns 25 are passed beneath the reference pattern detecting sensors 60Y-60K in accordance with the rotational movement of the transport belt 24. Further, in FIG. 6, the optical sensors 60 which are detecting the reference patterns 25 and outputting detection signals are indicated by black circles, and the optical sensors 60 which are not detecting the reference patterns and outputting no detection signals are denoted by white circles.

As shown in FIG. 6, the states of detection of the reference patterns by the respective optical sensors 64 in the states 6-1 to 6-5 are all different. Thus, it is possible to determine the positions of the reference patterns 25 moved beneath the reference pattern detecting sensors 60Y-60K, from the pattern detection states (states 6-1 to 6-5) that are represented by detection signals outputted by the respective optical sensors 64. By determining the positions of the reference patterns 25 in this manner, it is also possible to determine in real time the positions of the respective portions of the transport belt 24 which are moved beneath the reference pattern detecting sensors 60Y-60K.

Figure 7:
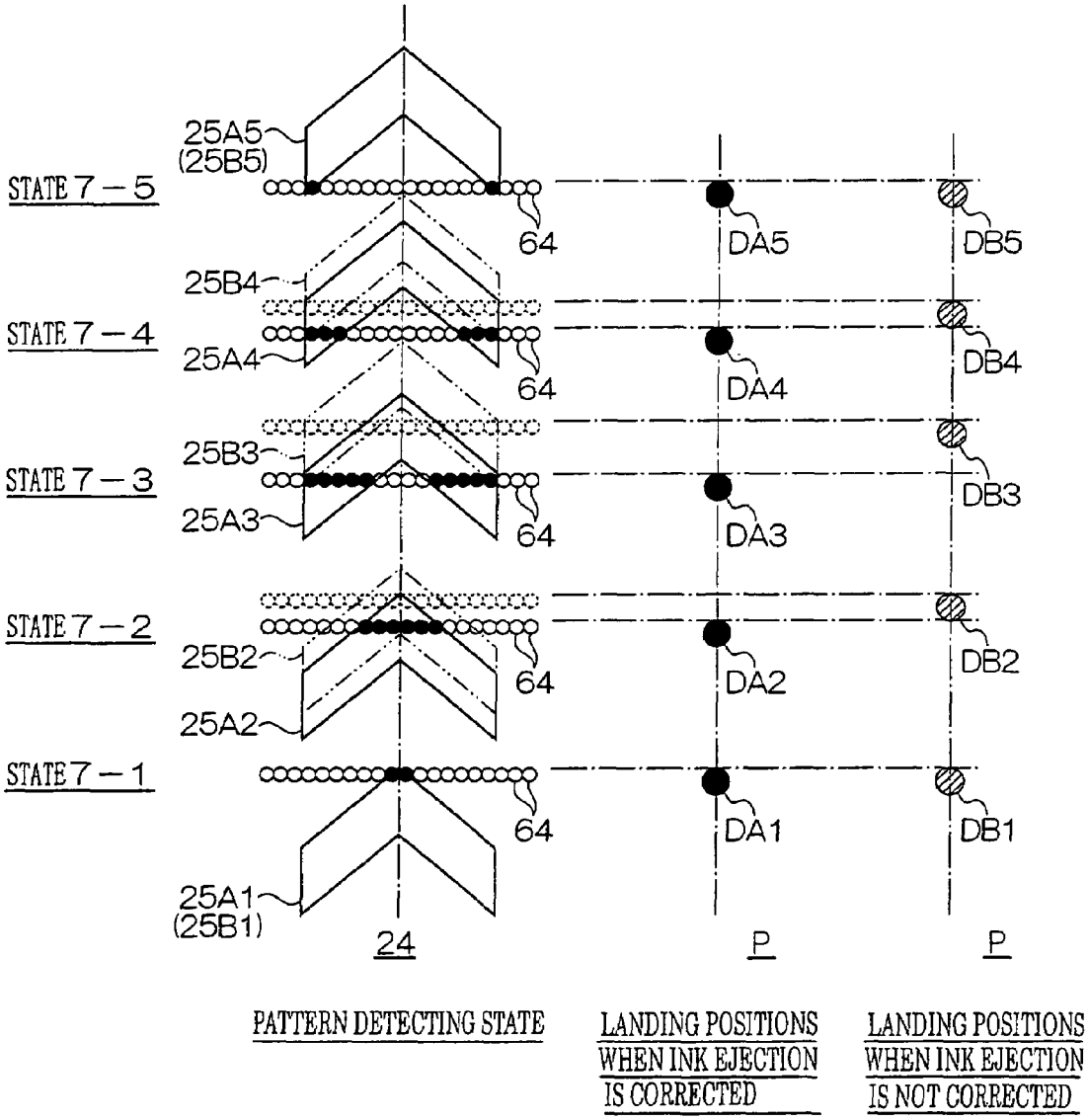
FIG. 7 is a view useful for explaining a process for detecting a speed change of the transport belt by means of the reference pattern detecting sensors according to the first embodiment of the present invention, and correction of ink ejection based on the detection.

FIG. 7 diagrammatically shows, in five stages (states 7-1 to 7-5), a process in which the reference patterns 25 are detected by the respective optical sensors 64 of the reference pattern detecting sensors 60Y-60K when the transport belt 24 is subjected to speed change. FIG. 7 also shows the landing positions of ink droplets on the paper P when ink ejection correction is and is not made in the states 7-1 to 7-5. In FIG. 7, the positions of the reference patterns 25 when speed change occurs are indicated by 25A1-25A5, and the positions of the reference patterns 25 when no speed change occurs are denoted by 25B1-25B5. Further, regarding the states of detection of the reference patterns 25 by the optical sensors 64, the optical sensors 64 which are detecting the reference patterns are indicated by black circles, and the optical sensors 64 which are not detecting the reference patterns are represented by white circles, as in FIG. 6.

As shown in FIG. 7, in the course of transition of the reference pattern 25 from the state 7-1 to the state 7-5, between the states 7-2 to 7-4 inclusive, the speed of the transport belt 24 is slower than the regular speed. Here, the calculating unit 70 calculates a speed change (speed delay amount in this example) of the transport belt 24 in the states 7-2 to 7-4 from the change in the pattern detection state represented by a detection signal derived from each optical sensor 64 in the states 7-1 to 7-5, and outputs the calculation result to the ink ejection control unit 72.

The ink ejection control unit 72 controls ejection timing of ink droplets ejected from the respective nozzles of the recording heads 52Y-52K, based on the result of calculation of the speed change of the transport belt 24 which is inputted thereto from the calculating unit 70, thereby correcting for the influence of the speed change of the transport belt 24. In the case of FIG. 7, in the states 7-2 to 7-4, the ejection timing of ink droplets ejected from the predetermined nozzles 56 of the recording heads 52Y-52K is delayed in accordance with the speed delay amount of the transport belt 24.

In this manner, the landing positions on the paper P where ink droplets are caused to land when ink ejection timing is corrected correspond to dots DA1 to DA5 respectively. On the other hand, the landing positions on the paper P where ink droplets are caused to land when ink ejection timing is not corrected correspond to dots AB1 to DB5 respectively. As can be seen from the figure, the landing positions of ink droplets are corrected in the states 7-2 to 7-4.

Although description has been made of the case where the influence of a speed change of the transport belt 24 is corrected by controlling ink ejection timing, it is also possible that similar control may be performed by controlling the drive motor 28 for rotationally moving the transport belt 24.

In such a case, the calculation result for speed change of the transport belt 24 derived from the calculating unit 70 is inputted to the belt drive control unit 74. The belt drive control unit 74 in turn controls the driving motor 28 so as to prevent the speed change of the transport belt 24 based on the calculation result for the speed change of the transport belt 24 which is inputted thereto from the calculating unit 70. In this manner, speed change of the transport belt 24 is prevented, and thus ink droplets are permitted to land at appropriate positions without correcting the ink ejection timing. Of course, it is also possible to prevent speed change of the transport belt 24 by the belt drive control unit 74, while at the same time correcting the ink ejection timing by using the ink ejection control unit 72 as mentioned above.

Figure 8:
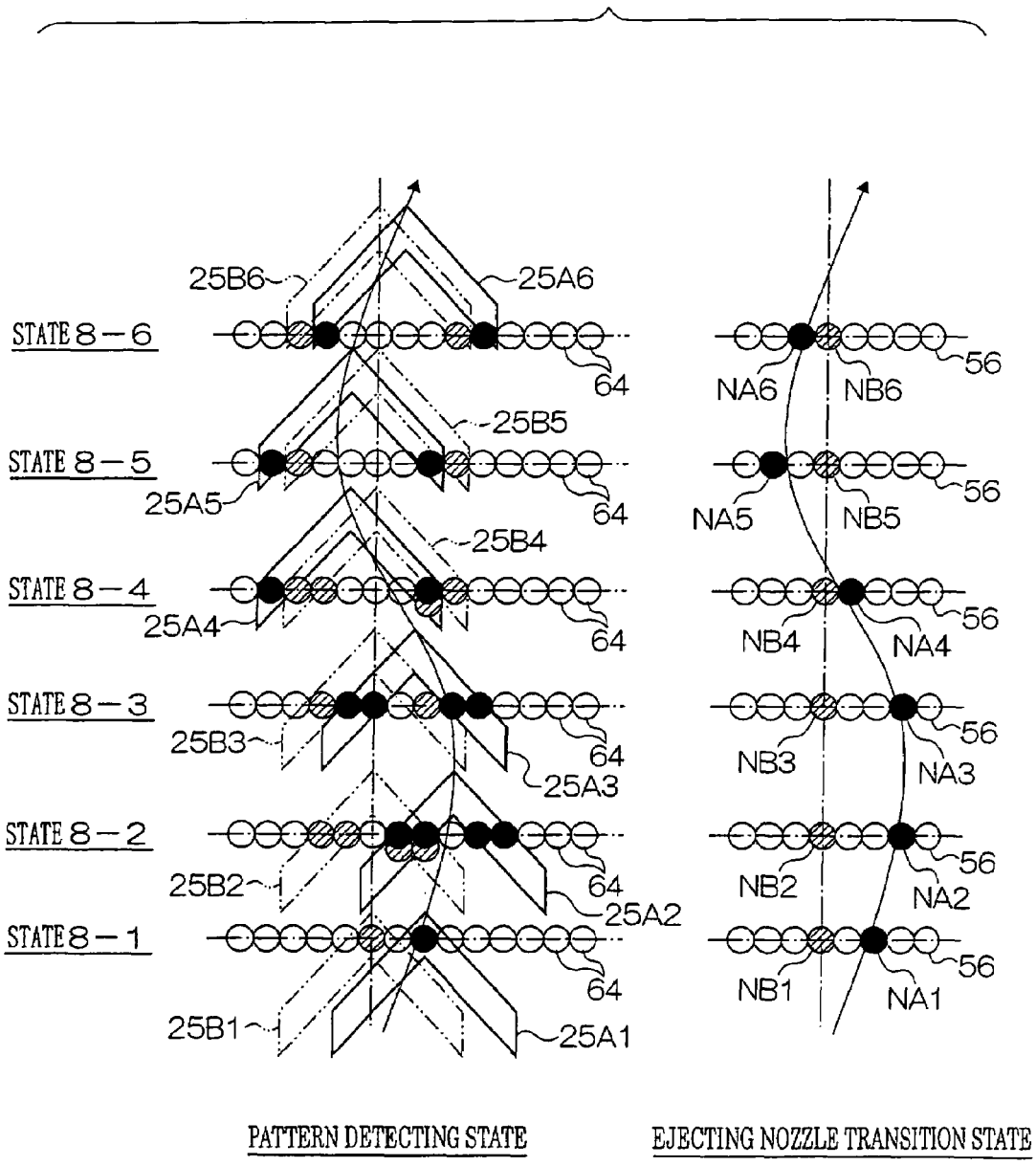
FIG. 8 is a view useful for explaining skew/walk of the transport belt by means of the reference pattern detecting sensors according to the first embodiment of the present invention, and transition of ink ejection nozzles based on the detection.

FIG. 8 diagrammatically shows, in six stages (states 8-1 to 8-6), a process in which the reference patterns 25 are detected by the respective optical sensors 64 of the reference pattern detecting sensors 60Y-60K when skew/walk of the transport belt 24 occurs. FIG. 8 also shows transition of nozzles 56 ejecting ink droplets in the states 8-1 to 8-6. In FIG. 8, the positions of the reference patterns 25 when skew/walk of the transport belt 24 occurs are indicated by 25A1-25A6 respectively. On the other hand, the positions of the reference patterns 25 when no skew/walk of the transport belt 24 is caused are indicated by 25B1-25B6 respectively. Further, regarding the states of detection of the reference patterns 25 by the optical sensors 64, the optical sensors 64 which are in a pattern detecting state when skew/walk of the transport belt 24 occurs are indicated by black circles, and the optical sensors 64 which are in a pattern detecting state when no skew/walk of the transport belt occurs are represented by white circles.

As shown in FIG. 8, in the course of movement of the reference patterns 25 from the state 8-1 to the state 8-6, the transport belt 24 is shifted in position in a direction perpendicular to the moving direction with respect to the normal movement locus thereof, and skew/walk occurring. At this point, the calculating unit 70 determines center positions in a direction perpendicular to the moving direction of the reference patterns 25 in the states 8-1 to 8-6 from changes of the pattern detecting states that are indicated by detection signals derived from the respective optical sensors 64 in the states 8-1 to 8-6, and calculates the position shift amount in a direction perpendicular to the moving direction of the transport belt 24. Then, the calculating unit 70 outputs the calculation result to the ink ejection control unit 72.

The ink ejection control unit 72 controls the ejection positions of ink droplets ejected from the plural nozzles 56 provided in the recording heads 52Y-52K (changes the nozzles to be used), based on the calculation result for the position shift amount in a direction perpendicular to the moving direction of the transport belt 24, and corrects for the influence of the position shift in the direction perpendicular to the moving direction of the transport belt 24.

In this manner, the positions of the nozzles 56 employed when the ink ejection positions are corrected are as indicated by NA1-NA6 respectively. On the other hand, the positions of the nozzles 56 employed when the ink ejection positions are not corrected are as shown by NB1 to NB6 respectively. Thus, as shown in FIG. 8, in the states 8-1 to 8-6, the positions of the nozzles 56 to be used are changed so that the landing positions of ink droplets on the paper P are corrected.

Although description has been made of the case where the influence of skew/walk of the transport belt 24 is corrected by controlling ink injection positions, in the image recording apparatus 10 according to this embodiment, it is also possible that similar correction may be made by controlling the belt handling roller 46 which causes the transport belt 24 to be shifted in position in a direction perpendicular to the direction of rotational movement of the transport belt 24 when the transport belt 24 is rotationally moved.

In this case, the calculation result for skew/walk of the transport belt 24 derived from the calculating unit 70 is inputted to the belt handling control unit 76. The belt handling control unit 76 in turn controls the position of the belt handling roller 46 so as to prevent skew/walk of the transport belt 24 based on the calculation result for the skew/walk of the transport belt 24 which is inputted thereto from the calculating unit 70. In this manner, skew/walk of the transport belt 24 is prevented, and thus ink droplets are permitted to land at appropriate positions without correcting the ink ejection timing. Of course, it is also possible to prevent skew/walk of the transport belt 24 by the belt handling control unit 76, while at the same time correcting the ink ejection timing by using the ink ejection control unit 72 as mentioned above.

Figure 9:
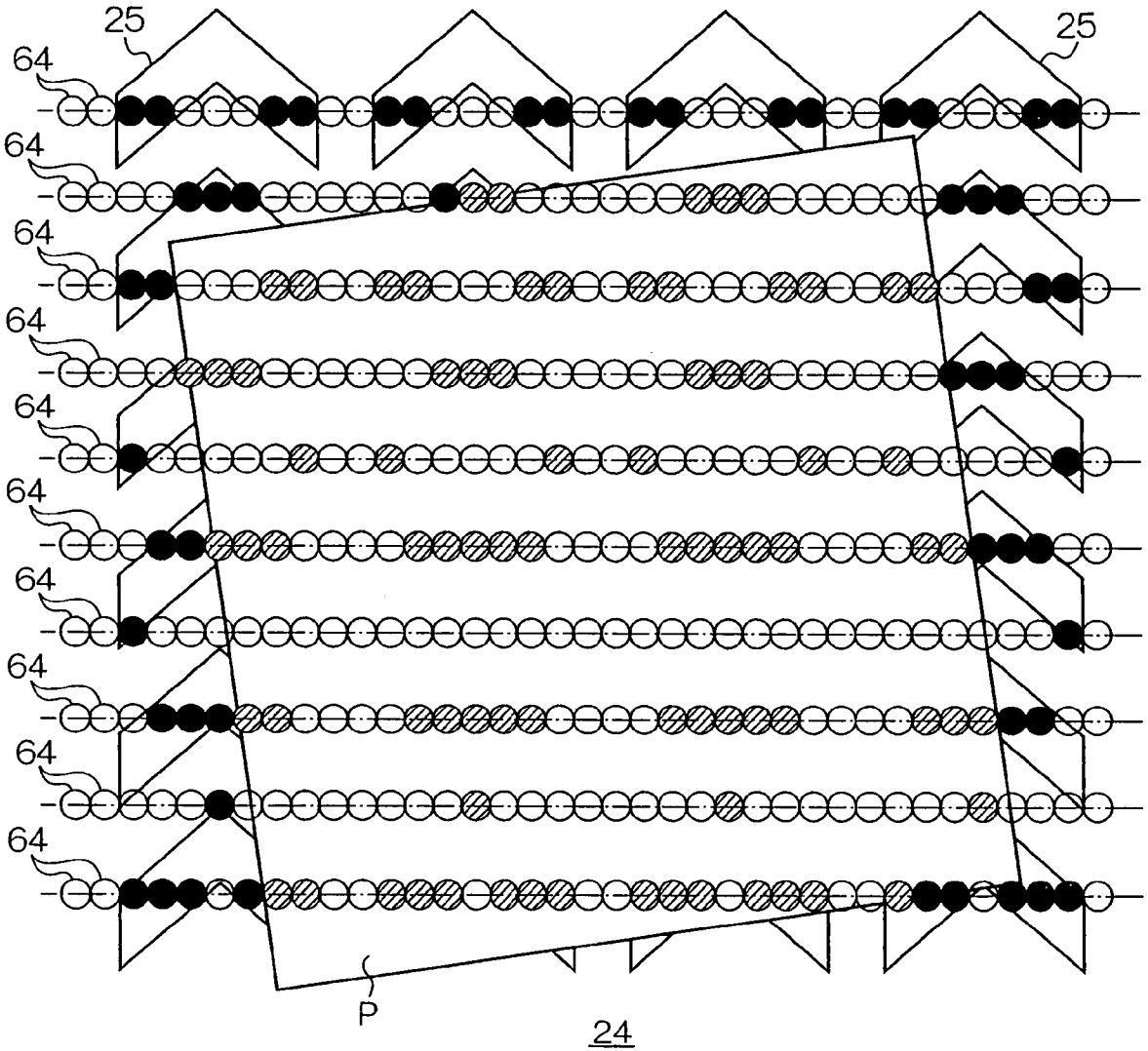
FIG. 9 is a view useful for explaining a process for detecting orientation of the paper attracted and attached to the transport belt according to the first embodiment of the present invention.

FIG. 9 shows a state in which the transport belt 24 having the paper P attracted and attached thereto passes beneath the reference pattern detecting sensors 60Y-60K. In FIG. 9, the optical sensors 64 which are in a pattern detecting state are indicated by black circles, the optical sensors 64 which are in a pattern non-detecting state because of the reference patterns 25 being concealed by the paper P are indicated by hatched circles (these optical sensors being in a pattern detecting state when no paper P is present), and the sensors 64 which are in a pattern non-detecting state irrespective of whether or not the paper P is present are represented by white circles.

As shown in FIG. 9, the paper P is attracted to the transport belt 24 while being inclined relative thereto. The calculating unit 70 calculates the inclination (the direction and angle of the inclination) of the paper P relative to the transport belt 24 from the pattern non-detecting state of each of the optical sensors 64 represented by the white circles, and outputs the calculation result to the ink ejection control unit 72.

The ink ejection control unit 72 changes ejection data so as to be consistent with the paper orientation based on the calculation result inputted thereto from the calculating unit 70 and thus controls the ejection positions of ink droplets ejected from the plural nozzles provided in the recording heads 52Y-52K, thereby changing the positions of the nozzles 56 to be used and correcting the landing positions of ink droplets on the paper P. In this manner, appropriate image recording commensurate with the inclination of the paper P is realized, and the influence of the inclination of the paper P is corrected.

As discussed above, the influence of speed change and/or skew/walk of the transport belt 24 and the influence of the orientation of the paper P are corrected. The paper P subjected to these corrections and having a color image recorded thereon is made to pass through the image forming portions 30T-30K, and detached from the transport belt 24 in response to further rotational movement of the transport belt 24. Then, the paper P is directed out to a downstream position in the transport path 20, and transported by the transport roller pairs 42 to the top of the image forming apparatus body 12 along the transport path 20 so as to be discharged to the catch tray 18. While the image-recorded paper P is being transported by the transfer roller pairs 42, ink transfer from the paper P to the spur rollers 40 is prevented by virtue of the fact that the contact area between the image-recorded surface of the paper P and each spur roller 40 is extremely small and a liquid-repellent film-like coating layer is provided on the surfaces of the projections of each spur roller 40. Thus, occurrence of ink bleeding on the image-recorded surface of the paper P is prevented by the contact of the paper P with the spur rollers 40.

Further, when double side printing is performed, the paper P having an image formed on one surface thereof and directed out from the image recording portions 30Y-30K to a downstream position in the transport path 20 is switched back at a downstream position in the transport path 20 and guided to the reverse transport path 22 so as to be transported along the reverse transport path 22 by the plural transport roller pairs 42 and returned, being turned up side down, to an upstream position in the transport path 20. Also when the image-recorded paper P is transported along the reverse transport path, occurrence of ink bleeding on the image-recorded surface of the paper P is prevented by virtue of the fact that the spur rollers 40 are disposed in contact with the image-recorded surface of the paper P and the paper P is transported by the plural transport roller pairs 42.

The paper P returned to an upstream position in the transport path 20 is again transported to the transport belt 24 by the transport roller pairs 36, and the image-recorded surface is attracted and attached to the surface 24A of the transport belt 24. Then, the paper P is transported through the image recording portions 30Y-30K, and ink droplets of the respective colors are ejected from the recording heads 52Y-52K to the non-recorded surface of the paper P so that a color image is formed thereon. Subsequently, the paper P having images formed on both surfaces thereof is directed out to a downstream position in the transport path 20 due to rotational movement of the transport belt 24 so as to be discharged to the catch tray 18.

As discussed above, color images are formed on the single sheet of paper P by the image recording apparatus 10. If the print job is to print a printed matter consisting of plural pages, printing of the second and succeeding pages is continuously performed, and in this case, the transport belt 24 is permitted to continue rotational movement. That is, the image recording apparatus 10 repeats the above-mentioned operation and records color images on the second and succeeding sheets of paper P. When printing corresponding to the number of pages contained in the print job is over, the image recording apparatus 10 ends the printing operation according to the current print job. If a next print job has already been entered, the image recording apparatus continuously performs a printing process according to the next printing job, whereas if no next print job has been entered, the transport belt 24 is stopped from rotational movement, and the image recording apparatus is now in a stand-by state waiting for a next print job to be entered.

In the maintenance of the image recording apparatus 10, the recording head unit 50 is located at the raised position as shown in FIG. 2, and the maintenance units 78Y-78K are positioned below the recording head unit 50. Under such a condition, predetermined operations such as dummy jet by the recording heads 52Y-52K, cleaning of the nozzle forming surface 54 of each recording head 52Y-52K, and seal of the nozzle forming surfaces 54 are performed.

The effect of the above-described image recording apparatus 10 will be explained below.

In the image recording apparatus 10 according to this embodiment, when the transport belt 24 is driven by the driving motor 28 in a direction to transport the paper P, the reference pattern detecting sensors 60Y-60K detect the reference patterns 25 provided on the surface 24A of the transport belt 24 which are moved as the transport belt 24 is driven. The calculating unit 70 calculates a speed change of the transport belt 24 and position shift of the transport belt 24 in a direction perpendicular to the transporting direction of the paper P (direction of rotational movement of the transport belt 24) based on detection information derived from the reference pattern detecting sensors 60Y-60K. The ink ejection control unit 72 controls ejection timing of ink droplets ejected from the plural nozzles 56 of the recording heads 52Y-52K based on the result of calculation of speed change of the transport belt 24 which is performed by the calculating unit 70, thereby correcting for the influence of the speed change of the transport belt 24. Further, the ink ejection control unit 72 controls the ejection positions of ink droplets ejected from the plural nozzles 56 of the recording heads 52Y-52K based on the result of calculation of the position shift of the transport belt 24 in a direction perpendicular to the transporting direction which is performed by the calculating unit 70, thereby correcting for the influence of the position shift in the direction perpendicular to the transporting direction of the transport belt 24. Thus, with the image recording apparatus 10 according to this embodiment, decrease in the image quality due to speed change and/or skew/walk of the transport belt 24 is prevented so that a high quality image can be recorded.

As discussed above, in the image recording apparatus according to this embodiment, the belt drive control unit 74 controls the driving motor 28 based on the result of calculation of speed change of the transport belt 24 which is performed by the calculating unit, thereby preventing speed change of the transport belt 24. Further, the belt handling control unit 76 controls the belt handling roller 46 based on the result of calculation of position shift in a direction perpendicular to the transporting direction of the transport belt 24 which is performed by the calculating unit 70, thereby preventing position shift in a direction perpendicular to the transporting direction of the transport belt 24. In this manner, decrease in image quality due to speed change and/or skew/walk of the transport belt 24 can be prevented so that high-quality image recording can be achieved.

In this embodiment, the calculating unit 70 further calculates an inclination of the paper P relative to the transport belt 24 based on detection information obtained by detecting the reference patterns 25 of the transport belt 24, which is driven with the paper P attracted thereto, by means of the reference pattern detecting sensors 60Y-60K. The ink ejection control unit 72 controls ejection positions of ink droplets ejected from the plural nozzles 56 of the recording heads 52Y-52K, based on the result of calculation of inclination of the paper P which is performed by the calculating unit 70, thereby correcting for the influence of inclination of the paper P relative to the transport belt 24. In this manner, ink contamination inside the image recording apparatus 10 and useless ink consumption which tend to be caused when the paper P is not appropriately attracted and attached to the transport belt 24 can be prevented.

Further, in the image recording apparatus according to this embodiment, even in a case where plural sheets of paper P are simultaneously transported while being arranged side by side in a widthwise direction of the transport belt 24 so as to carry out image recording with respect to the respective sheets of paper P at the same time, images can be recorded on the respective sheets of paper P by correcting for the influence of speed change and/or skew/walk of the transport belt 24 and the influence of paper orientation individually with respect to each sheet of paper P.

Figure 10:
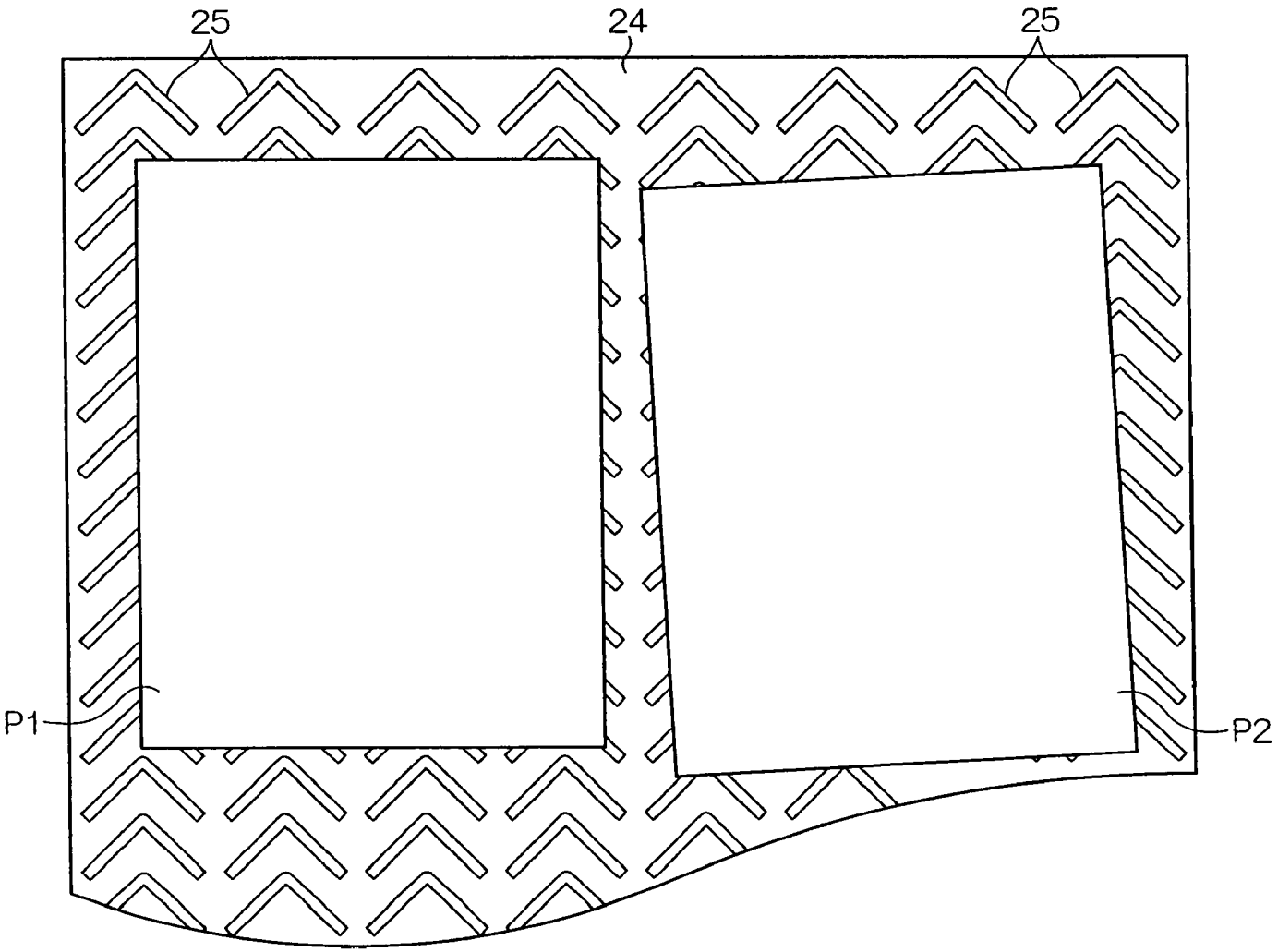
FIG. 10 is a plan view showing a state in which plural sheets of paper are attracted and attached to the transport belt according to the first embodiment of the present invention.

FIG. 10 shows an example wherein image recording is performed with two sheets of paper P1 and P2 attracted to the transport belt 24 and arranged widthwise relative thereto.

As shown in FIG. 10, the paper P1 on the left hand side is attracted in a predetermined position to the transport belt 24 without any inclination relative to the transport belt 24, while the paper P2 on the right hand side is attracted to the transport belt with an inclination relative to the transport belt 24. Even with the sheets of paper P1 and P2 attracted to the transport belt 24 in such orientations in the image recording apparatus 10 according to this embodiment, during the printing operation, the calculating unit 70 calculates speed change and/or skew/walk of the transport belt 24 and inclinations of the sheets of paper P1 and P2 relative to the transport belt 24 based on detection information obtained by detecting the reference patterns 25 of the transport belt 24 by means of the reference pattern detecting sensors 60Y-60K. Based on the result of these calculations, the influence of speed change and/or skew/walk of the transport belt 24 and the influence of the orientation of each sheet of paper P1, P2 are corrected in real time so that high quality image recording can be achieved at an appropriate position on each sheet of paper P1, P2.

Figure 11A:
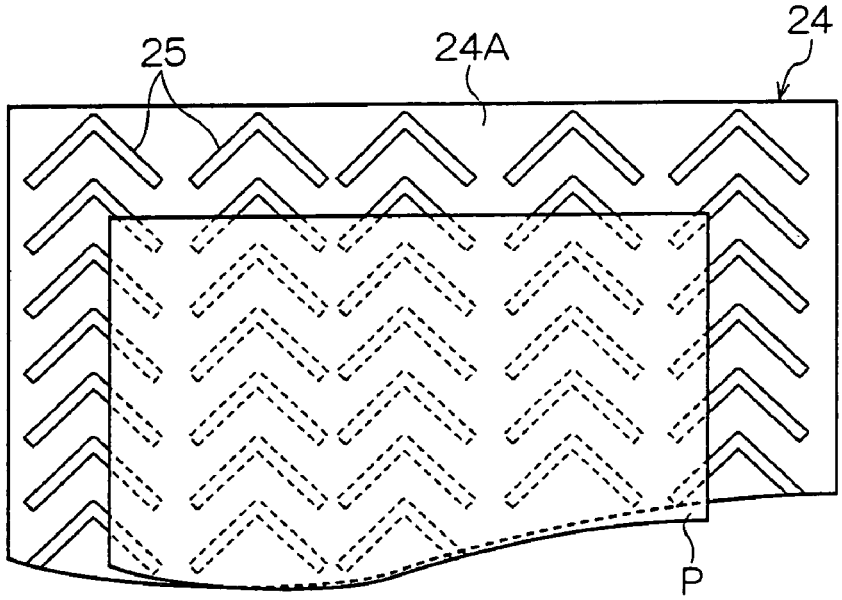
FIG. 11A is a plan view showing a state in which the reference patterns are provided on the entire area of the surface of the transport belt.
Figure 11B:
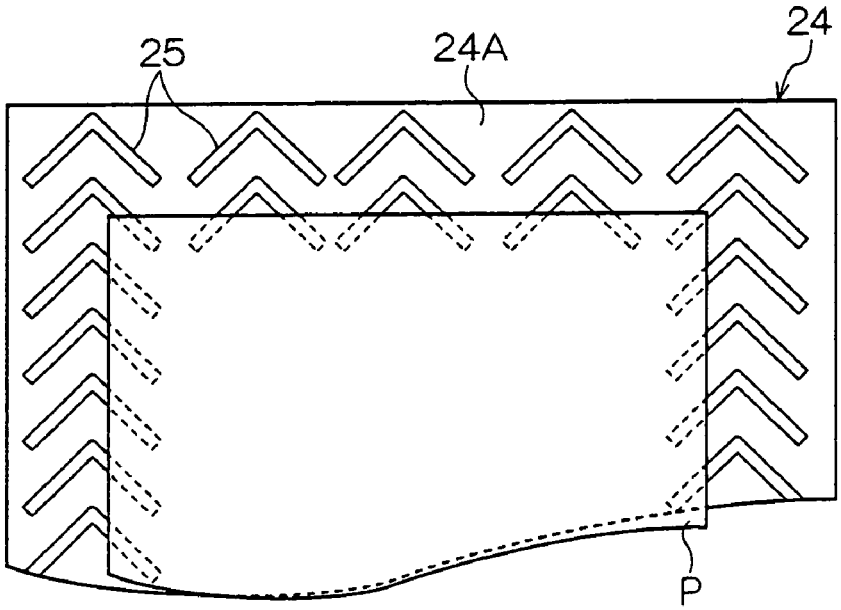
FIG. 11B is a plan view showing a state in which the reference patterns are provided only on a necessary area of the surface of the transport belt.

Meanwhile, in the image recording apparatus 10 according to this embodiment, it is possible that the reference patterns 25 provided on the surface 24A of the transport belt 24 may be provided only on a desired area, excluding the area where the paper P is attracted, of the surface 24A as shown in FIG. 11B, in addition to the case where the reference patterns 25 are provided on the entire area of the surface 24A as shown in FIG. 11A. By arranging such that no reference patterns 25 are provided on the surface area to which the paper P is attracted, the number of the reference patterns to be provided can be decreased so that the cost for fabricating the transport belt 24 can be reduced.

Second Embodiment

According to a second embodiment of the present invention, the reference patterns provided on the transport belt in the image recording apparatus 10 according to the first embodiment are modified. The reference patterns of the transport belt according to the second embodiment will be described below.

Figure 12:
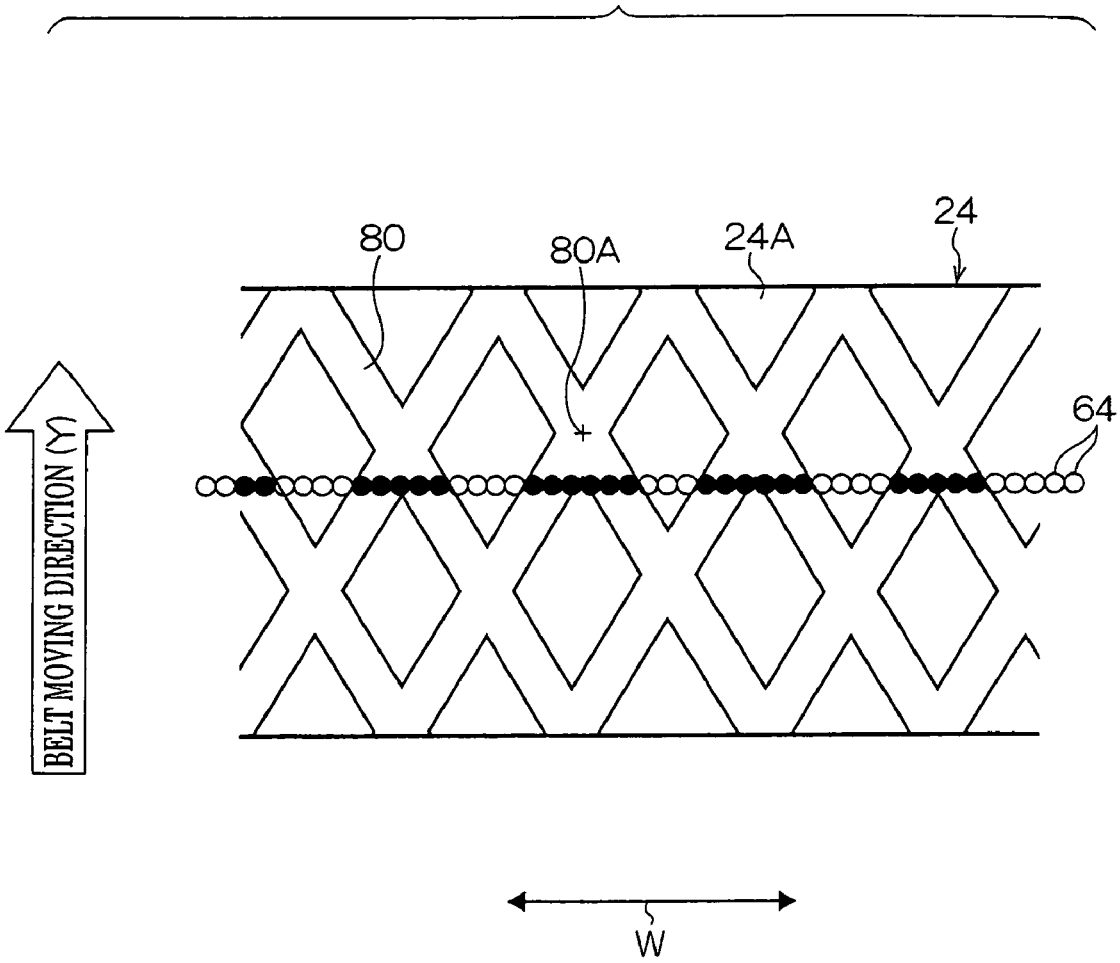
FIG. 12 is a plan view showing the positional relationship between the transport belt provided with the reference patterns according a second embodiment of the present invention and the optical sensors of the reference pattern detecting sensors.

FIG. 12 illustrates reference patterns 80 provided on the surface 24A of the transport belt 24 according to this embodiment.

As shown in FIG. 12, the reference patterns 80 according to this embodiment are X-shaped patterns defined by crossing of plural slant lines sloped down to the right and arranged in uniformly spaced parallel relationship with each other and plural slant lines sloped down to the left and arranged in uniformly spaced parallel relationship with each other, on the assumption that the surface 24A is viewed with the direction of rotational movement of the transport belt 24 directed upward. The reference patterns 80 are also colored to be in high contrast to the transport belt 24 and are provided on substantially the entire area of the surface 24A of the transport belt 24. In FIG. 12, regarding the state of detecting the reference patterns 80 by the optical sensors 64, the optical sensors 64 which are in a pattern directing state are indicated by black circles, and the optical sensors 64 which are in a pattern non-detecting state are denoted by white circles.

In the case of such X-shaped reference patterns 80, when the reference patterns 80 are passed beneath the reference pattern detecting sensors 60Y-60K in accordance with rotational movement of the transport belt 24, the state of detecting the reference patterns 80 by the optical sensors 64 is changed in real time in accordance with movement of the reference patterns 80 as in the case of the reference patterns 25 (chevron patterns) according to the first embodiment. By carrying out the detection with crossing points 80A of the slant lines of the reference patterns 80 as reference points, it is possible to determine the positions of the reference patterns 80 and the position of the transport belt 24 in real time. Thus, during a printing operation performed by the image recording apparatus 10, the influences of speed change of the transport belt 24 and position shift of the transport belt 24 in a direction perpendicular to the transporting direction of the transport belt 24 can be corrected, so that high quality image recording can be achieved wherein a decrease in image quality due to such influences is suppressed.

In addition, with the reference patterns 80, the influence of inclination of the paper P relative to the transport belt 24 such as explained above in the first embodiment can also be corrected. Thus, it is possible to prevent ink contamination inside the apparatus and useless ink consumption which tend to occur when the paper P is inappropriately attracted to the transport belt 24, during a printing operation performed by the image recording apparatus 10.

Third Embodiment

According to a third embodiment of the present invention, the reference patterns provided on the transport belt in the image recording apparatus 10 according to the first embodiment are modified into patterns different from the ones according to the second embodiment. The reference patterns of the transport belt according to the third embodiment will be described below.

Figure 13:
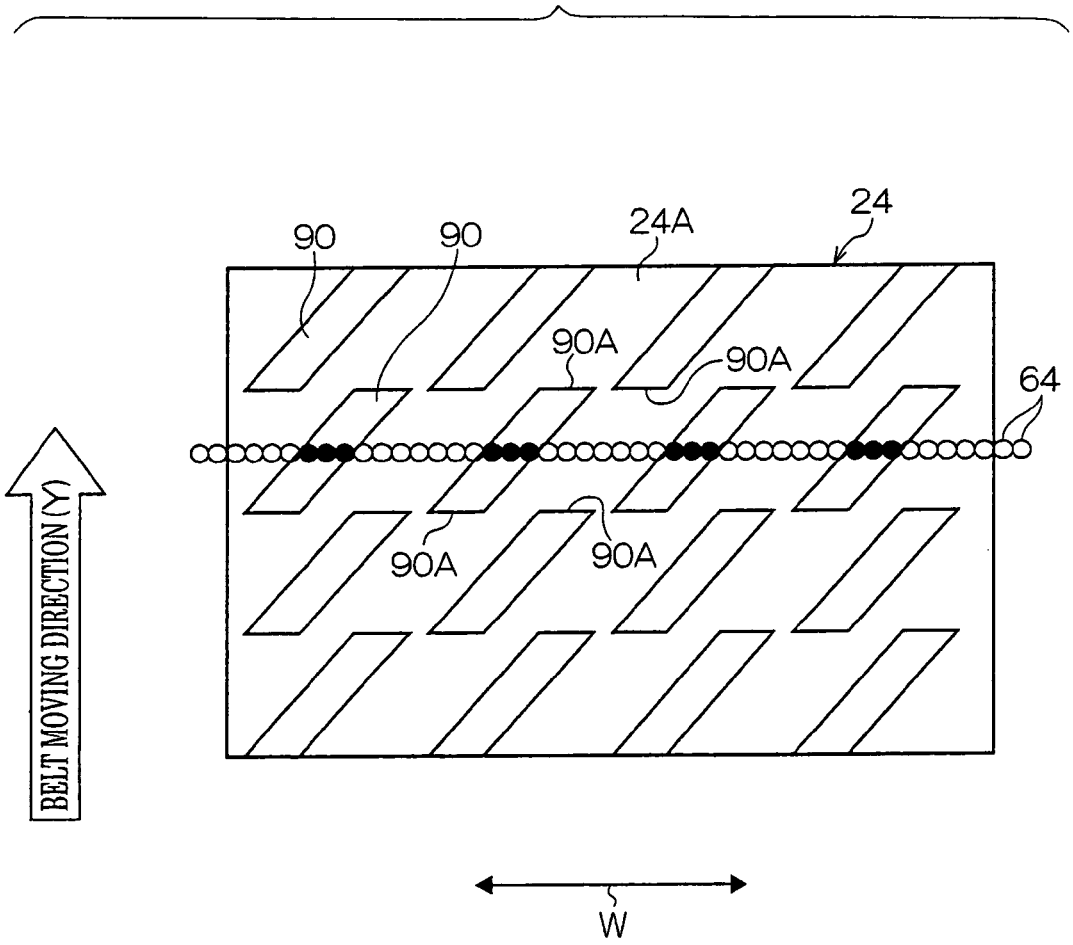
FIG. 13 is a plan view showing the positional relationship between the transport belt provided with the reference patterns according a third embodiment of the present invention and the optical sensors of the reference pattern detecting sensors.

FIG. 13 illustrate reference patterns 90 which are plurally provided on the surface 24A of the transport belt 24.

As shown in FIG. 13, the reference patterns 90 according to this embodiment are slant line-like patterns sloped down to the left when the surface 24A is viewed with the direction of rotational movement of the transport belt 24 directed upward. Further, the respective reference patterns 90 are arranged in the form of a matrix such that the reference patterns 90 are arrayed with predetermined spacing in a widthwise direction (direction indicated by arrows W in FIG. 13) perpendicular to the direction of rotational movement of the transport belt 24 and respective ends 90A of the reference patterns 90 adjacent to each other in the direction of rotational movement of the transport belt 24 are positioned substantially in alignment with each other in the direction of rotational movement of the transport belt 24. Still further, the reference patterns 90 are also colored to be in high contrast to the transport belt 24 and are provided on substantially the entire area of the surface 24A of the transport belt 24. In FIG. 13, regarding the state of detecting the reference patterns 90 by the optical sensors 64, the optical sensors 64 which are in a pattern directing state are indicated by black circles, and the optical sensors 64 which are in a pattern non-detecting state are denoted by white circles.

In the case of this embodiment wherein such slant line-like reference patterns 90 are plurally provided, pattern detection is made with the ends 90A of the reference patterns 90 as reference. However, in the case of the reference patterns 90, the position of the transport belt 24 cannot be determined by detecting the ends 90A only once. Therefore, as shown in the flow chart of FIG. 14, pattern detecting states are compared on a time series basis, thereby determining the positions of the reference patterns 90, or the position of the transport belt 24.

Figure 14:
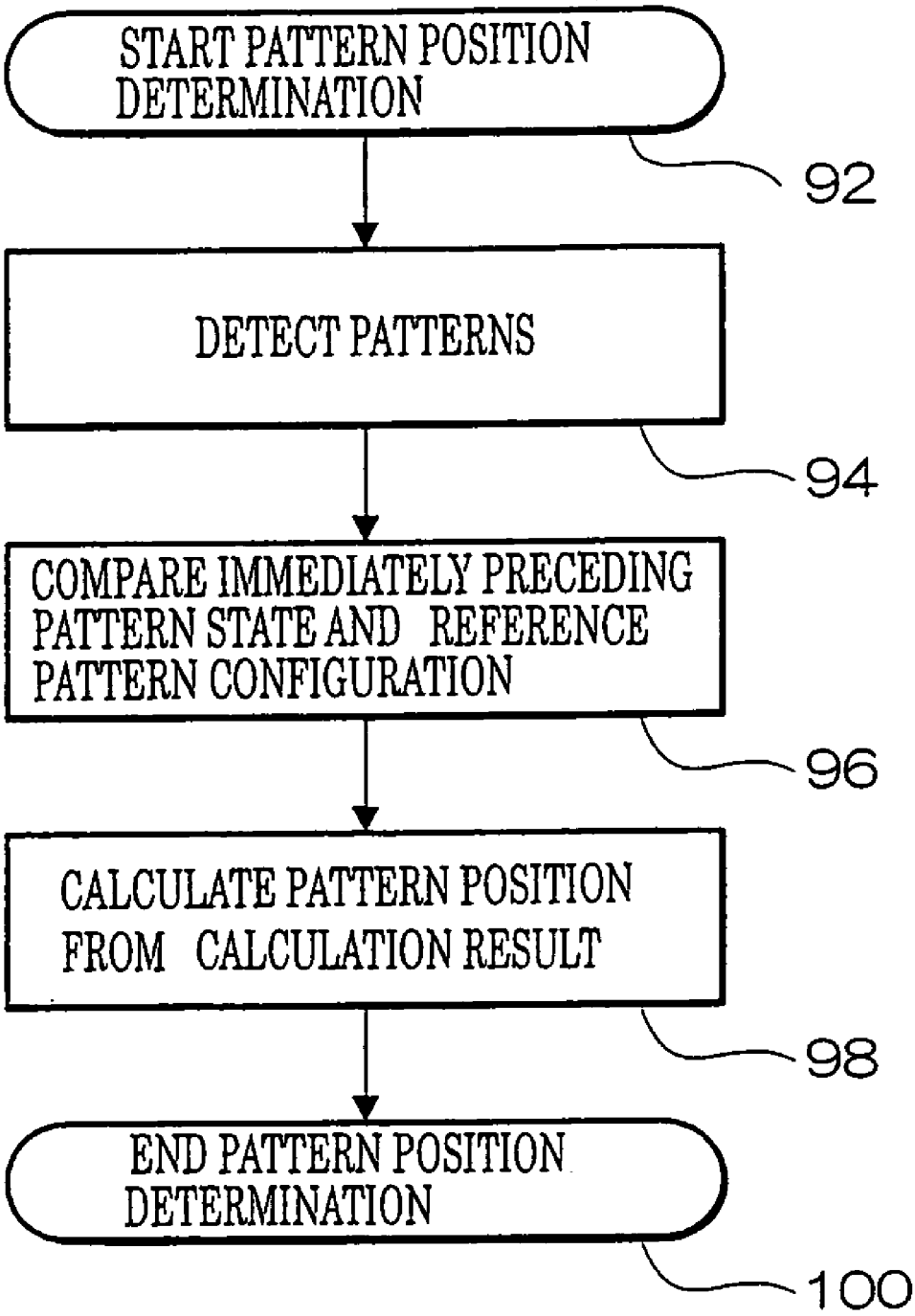
FIG. 14 is a flow chart illustrating the flow of the operation for determining the position of the transport belt provided with the reference patterns according to the third embodiment of the present invention.

When detecting the reference patterns 90, as shown in FIG. 14, the operation for determining the positions of the patterns is started at step 92. Then, at step 94, the reference patterns 90, which are moved in the direction of rotational movement of the transport belt 24 in accordance with the rotational movement of the transport belt 24, are continuously detected with specified sampling time by the respective optical sensors 64 of the reference pattern detecting sensors 60Y-60K. Subsequently, at step 96, the configurations of the reference patterns 90 detected with specified timing are compared with the patterns states detected immediately before the specified timing. Thereafter, at step 98, the calculating unit 70 is permitted to calculate the pattern positions based on the result of the comparison. At step 100, the operation for determining the positions of the patterns is ended.

By executing the above-described pattern detection, the position of the transport belt 24 provided with the reference patterns 90 according to this embodiment can also be determined. Thus, during a printing operation performed by the image recording apparatus 10, the influences of speed change of the transport belt 24 and position shift of the transport belt 24 in a direction perpendicular to the transporting direction of the transport belt 24 can be corrected, so that high quality image recording can be achieved wherein a decrease in image quality due to such influences is suppressed.

In addition, also with the reference patterns 90, the influence of inclination of the paper P relative to the transport belt 24 such as explained above in the first embodiment can be corrected. Thus, it is possible to prevent ink contamination inside the apparatus and useless ink consumption which tend to occur when the paper P is inappropriately attracted and attached to the transport belt 24, during a printing operation performed by the image recording apparatus 10.

Fourth Embodiment

According to a fourth embodiment of the present invention, the reference patterns provided on the transport belt in the image recording apparatus 10 according to the first embodiment are modified into patterns different from the ones according to the second and third embodiments. The reference patterns of the transport belt according to the fourth embodiment will be described below.

Figure 15:
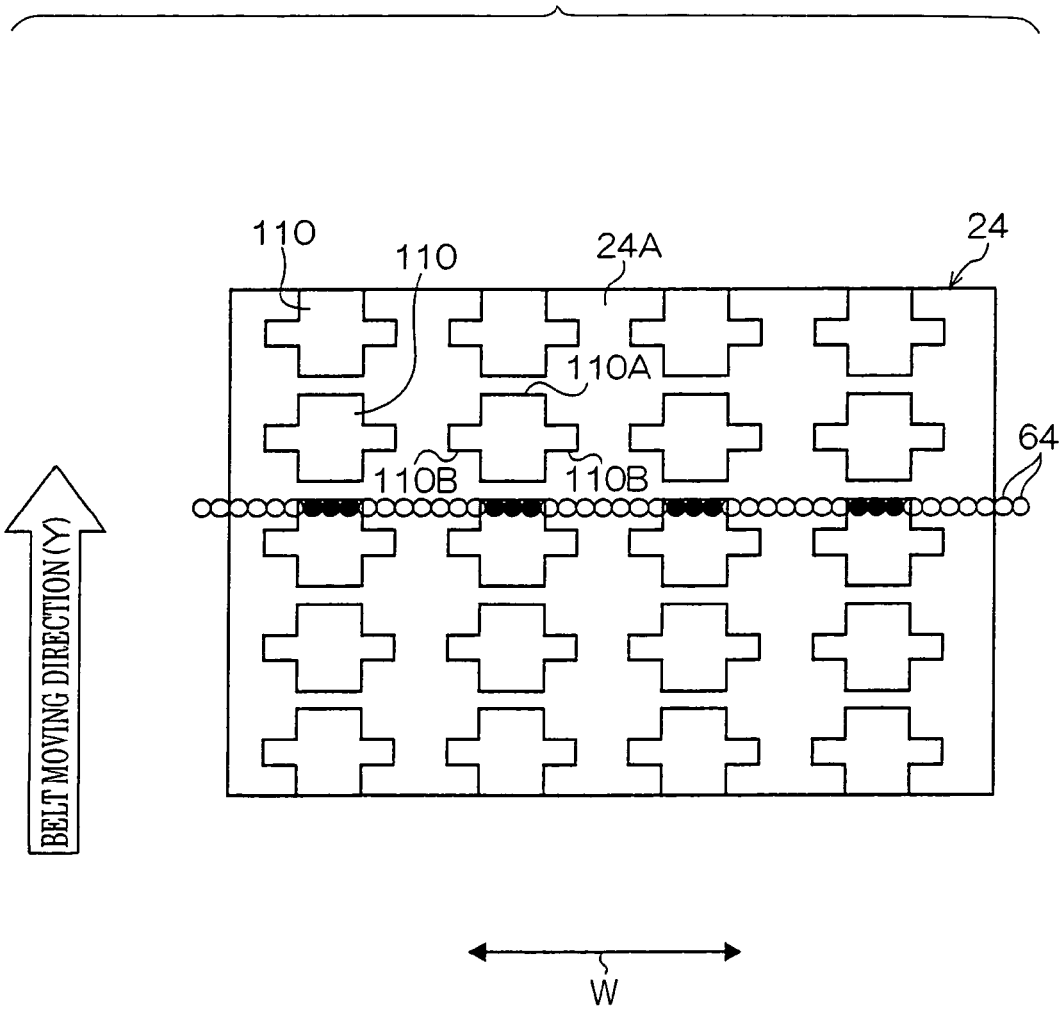
FIG. 15 is a plan view showing the positional relationship between the transport belt provided with the reference patterns according a fourth embodiment of the present invention and the optical sensors of the reference pattern detecting sensors.

FIG. 15 illustrates reference patterns 110 which are plurally provided on the surface 24A of the transport belt 24.

As shown in FIG. 15, the reference patterns 110 according to this embodiment are patterns having cross shapes when the surface 24A is viewed with the direction of rotational movement of the transport belt 24 directed upward. Further, the respective reference patterns 110 are arranged in the form of a matrix such that the reference patterns 110 are arrayed with predetermined spacing in the direction of rotational movement of the transport belt 24 and in a widthwise direction (direction indicated by arrows W in FIG. 15) perpendicular to the direction of rotational movement of the transport belt 24 and respective ends 110A of the reference patterns 110 adjacent to each other in the direction of rotational movement of the transport belt 24, and are provided on substantially the entire area of the surface 24A of the transport belt 24. Still further, the reference patterns 110 are also colored to be in high contrast to the transport belt 24. In FIG. 15, regarding the state of detecting the reference patterns 110 by the optical sensors 64, the optical sensors 64 which are in a pattern directing state are indicated by black circles, and the optical sensors 64 which are in a pattern non-detecting state are denoted by white circles.

In the case of this embodiment wherein such cross-like reference patterns 110 are plurally provided, the pattern detection is made with the ends 110A of the reference patterns 110 as reference. However, also in the case of the reference patterns 110, the position of the transport belt 24 cannot be determined by detecting the ends 110A only once as in the case of the reference patterns 90 in the third embodiment. Therefore, as shown in the flow chart of FIG. 16, pattern detecting states are compared on a time series basis, thereby determining the positions of the reference patterns 110, or the position of the transport belt 24. Further, speed change of the transport belt 24 is determined from change in the transit time (movement speed) when lateral portions 110B extending to the left and right of the reference patterns 110 pass beneath the reference pattern detecting sensors 60Y-60K.

Figure 16:
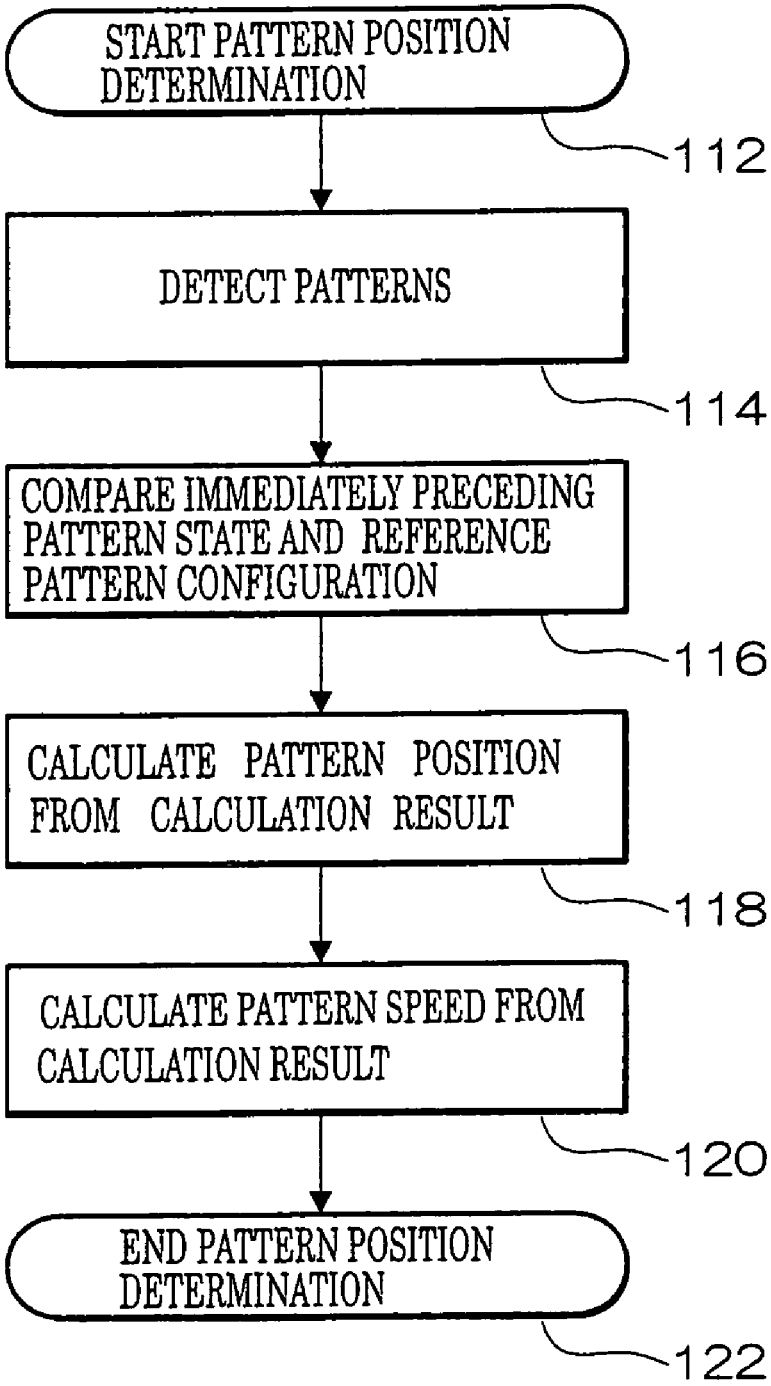
FIG. 16 is a flow chart illustrating the flow of the operation for determining the position of the transport belt provided with the reference patterns according to the fourth embodiment of the present invention.

When detecting the reference patterns 110, as shown in FIG. 16, the operation for determining the positions of the patterns is started at step 112. Then, at step 114, the reference patterns 110, which are moved in the direction of rotational movement of the transport belt 24 in accordance with the rotational movement of the transport belt 24, are continuously detected with specified sampling time by the respective optical sensors 64 of the reference pattern detecting sensors 60Y-60K. Subsequently, at step 116, the configurations of the reference patterns 110 detected with specified timing are compared with the patterns states detected immediately before the specified timing. Thereafter, at step 118, the calculating unit 70 calculates the pattern positions based on the result of the comparison. Further, at step 120, the calculating unit 70 calculates the movement speeds of the patterns (speed changes) based on the result of the comparison. At step 122, the operation for determining the positions of the patterns is ended.

By executing the above-described pattern detection, the position of the transport belt 24 provided with the reference patterns 90 according to this embodiment can also be determined. Thus, during printing operation performed by the image recording apparatus 10, the influences of speed change of the transport belt 24 and position shift of the transport belt 24 in a direction perpendicular to the transporting direction of the transport belt 24 can be corrected, so that high quality image recording can be achieved wherein a decrease in image quality due to such influences is suppressed.

In addition, also with the reference patterns 110, the influence of inclination of the paper P relative to the transport belt 24 such as explained above in the first embodiment can be corrected. Thus, it is possible to prevent ink contamination inside the apparatus and useless ink consumption which tend to occur when the paper P is inappropriately attracted and attached to the transport belt 24, during a printing operation performed by the image recording apparatus 10.

Fifth Embodiment

According to a fifth embodiment of the present invention, reference patterns such as described in the first to fourth embodiments are formed on the transport belt 24 with inks ejected from the recording heads. The structure of the image recording apparatus according to the fifth embodiment will now be described with reference to FIG. 17. In the image recording apparatus 130 according to this embodiment illustrated in FIG. 17, parts similar to those of the image recording apparatus according to the first embodiment are indicated by like reference numerals, and description thereof is omitted.

Figure 17:
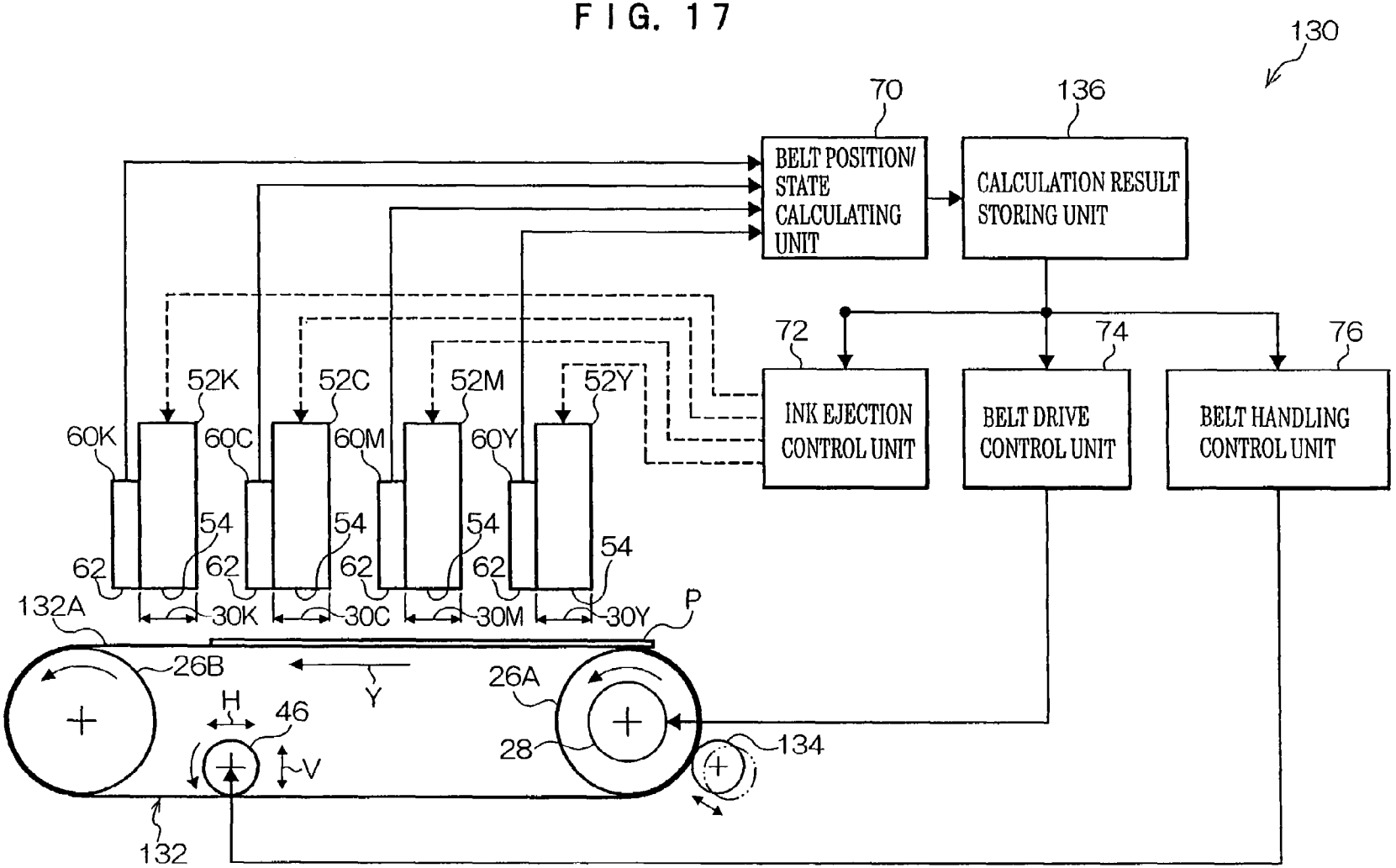
FIG. 17 is a diagrammatical view showing the structure of a major portion of the image recording apparatus according to a fifth embodiment of the present invention.

As shown in FIG. 17, in the image recording apparatus 130 according to this embodiment, an endless transport belt 132 is provided below recording heads 52Y-52K in such a manner as to extend substantially horizontally, and entrained about a pair of rollers 26A and 26B. No reference patterns such as described above are provided on the surface 132A of the transport belt 132, and the color of the surface 132A is the color of the material of the belt, white or the like.

Slightly below the upstream side of the transport belt 132, a belt cleaner 134 for removing and cleaning ink adhered to the surface 132A of the transport belt 132 is provided in such a manner as to be able to be brought into and out of contact with the surface 132A of the transport belt 132. The belt cleaner 132 is normally disposed in spaced relationship with the surface 132A of the transport belt 132.

Reference pattern detecting sensors 60Y, 60M, 60C and 60K, which are provided on recording heads 52Y, 52M, 52C and 52K for respective colors, are disposed adjacent to the recording heads 52Y, 52M, 52C and 52K on the downstream side in the transporting direction of paper P, respectively. A calculating unit 70, which calculates the position of the transport belt 132 based on detection signals derived from the reference pattern detecting sensors 60Y-60K, is connected to a memory unit 136 which stores the result of the calculation performed by the calculating unit 70. The memory unit 136 is connected to an ink ejection control unit 72, a belt drive control unit 74, and a belt handling control unit 76.

The image recording apparatus 130 according to this embodiment is configured as described above and designed such that a speed change of the transport belt 132 and position shift of the transport belt 132 in a direction perpendicular to its transporting direction are detected during a period other than the image recording period for the paper P (printing operation period)

When the above detection is executed, first of all, the transport belt 132 having no paper P attracted thereto is rotated in a predetermined direction of rotational movement in order to form reference patterns such as described in the first to fourth embodiments (reference patterns 25, 80, 90, 110) on the surface 132A of the transport belt 132 with inks of respective colors or a single color which are ejected from the recording heads 52Y-52K.

After the pattern formation on the transport belt 132, the reference patterns, which are moved with the rotational movement of the transport belt 132, are detected by means of the reference pattern detecting sensors 60Y, 60M, 60C and 60K provided in correspondence to the recording heads 52Y, 52M, 52C and 52K for respective colors, in accordance with that one of the detection methods described in the first to fourth embodiments which is suitable for the configuration of the reference patterns.

Subsequently, the calculating unit 70 calculates speed change of the transport belt 132 and position shift (skew/walk) of the transport belt 132 in a direction perpendicular to the transporting direction of the transport belt 132 based on detection information derived from the reference pattern detecting sensors 60Y-60K, and the result of the calculation is stored in the memory unit 136.

After the pattern detecting and calculation result storing procedures are finished, the belt cleaner 134 is brought into pressure contact with the surface 132A of the transport belt 132, thereby removing the reference patterns formed of inks and cleaning the surface 132A of the transport belt 132. After the cleaning of the transport belt 132, the belt cleaner 134 is brought out of contact with the surface 132A of the transport belt 132.

By the above manner, the procedure of detecting a speed change of the transport belt 132 and a position shift in a direction perpendicular to the transporting direction of the transport belt 132 is completed. The detection described above is performed as occasion demands, for example when the image recording apparatus 130 is initially started or after the apparatus undergoes maintenance. Alternatively, such detection may be carried out on regular basis in accordance with a predetermined condition such as after printing is executed for a number of sheets of paper preset by the user.

With the image recording apparatus 130 wherein the foregoing detection has been carried out with respect to the transport belt 132, the ink ejection control unit 72 controls the ejection timing of ink droplets ejected from plural nozzles 56 of the recording heads 52Y-52K, based on the result of calculation of a speed change of the transport belt 132 which is stored in the memory unit 136, thereby correcting for the influence of the speed change of the transport belt 132. In addition, the ink ejection control unit 72 also controls the ejection positions of ink droplets ejected from the plural nozzles of the recording heads 52Y-52K, thereby correcting for the influence of a position shift in a direction perpendicular to the transporting direction of the transport belt 132.

Further, in correction procedures executed by a belt drive control unit 74 and belt handling control unit 76, the belt drive control unit 74 controls a drive motor 28 based on the result of calculation of speed change of the transport belt 132 which is stored in the memory unit 136, thereby suppressing the speed change of the transport belt 132, and the belt handling control unit 76 controls a belt handling roller 46 based on the result of calculation of position shift in a direction perpendicular to the transporting direction of the transport belt 132 which is stored in the memory unit 136, thereby suppressing the position shift in the direction perpendicular to the transporting direction of the transport belt 132.

As will be appreciated from the above discussion, also with image recording apparatus 130 according to this embodiment, a decrease in image quality due to a speed change and/or skew/walk of the transport belt 132 transporting the paper P can be prevented so that a high quality image can be recorded.

Sixth Embodiment

According to a sixth embodiment of the present invention, as in the case of the image recording apparatus according to the fifth embodiment, reference patterns are formed of inks on the transport belt 132, and detection is made of the reference patterns. Further, a speed change and/or skew/walk of the transport belt 132 is calculated, and the result of the calculation is stored in the memory unit 136.

In the sixth embodiment, unlike the fifth embodiment, no belt cleaning is carried out thus allowing the reference patterns to remain on the transport belt after the reference patterns are detected and the result of the calculation is stored. During a printing operation, image recording is performed with paper P attracted to the transport belt 132, and correction is made for a speed change and/or skew/walk of the transport belt 132 through real-time detection of the reference patterns formed on the transport belt 132. Alternatively, such correction is made based on the result of calculation which is stored in the memory unit 136 as in the fifth embodiment. In addition, paper orientation such as described in the first embodiment is detected using the reference patterns formed on the transport belt 132, thereby controlling ink ejection in accordance with the orientation of the paper.

In this manner, also in the sixth embodiment, decrease in image quality due to speed change and/or skew/walk of the transport belt is suppressed so that a high-quality image can be recorded. Further, it is also possible to prevent ink contamination inside the apparatus and useless ink consumption which tend to be caused when the paper P is inappropriately attracted to the transport belt 132.

However, in the case of reference patterns formed from inks on the transport belt 132 as described above, there is a likelihood that the reference patterns are eroded or become generally thinner to be unclear in contour or as a whole due to friction with the paper or the like as the number of sheets of paper increases. For this reason, before difficulty is encountered in performing the pattern detection (for example, after a predetermined number of sheets of paper are printed), belt cleaning is carried out to remove deteriorated reference patterns and new reference patterns are formed on the transport belt. Each time new reference patterns are formed, pattern detection may be carried out, speed change and/or skew/walk of the transport belt may be calculated, and the result of the calculation may be stored in the memory unit.

Although the present invention has been described in detail with respect to the first to sixth embodiments thereof, the present invention is by no means limited thereto, and other various embodiments can be implemented within the scope of the present invention.

For example, while in the image recording apparatus 130 described in the fifth embodiment, four reference pattern detecting sensors for detecting the reference patterns of the transport belt are provided in correspondence to the recording heads for respective colors, it is also possible that three or less such reference pattern detecting sensors may be provided in the image recording apparatus 130. Even in a case where a single reference pattern detecting sensor is provided, the respective corrections based on pattern detection can be carried out.

Although in the foregoing embodiments, description has been made of image recording apparatus (inkjet recording apparatus) wherein a recording medium attracted and attached to and supported on an electrostatic attracting belt is transported to image recording positions where image recording is performed by recording heads, by way of example, the present invention is not limited to such a belt transporting type apparatus but is equally applicable to a drum transporting type apparatus wherein a recording medium is wound on, attracted and attached to and supported on a rotary drum so as to be transported to positions where image recording is performed by recording heads.

What is claimed is:

1. An image recording apparatus wherein an image is recorded on a recording medium being transported, by ejecting ink droplets from plural ink ejection ports provided in a recording head, the apparatus comprising:

a transport member for transporting a recording medium supported on a surface thereof to an image forming position defined by the recording head;

a drive unit that drives the transport member in a transporting direction of the recording medium;

a reference pattern provided on the surface of the transport member, said reference pattern comprising a plurality of X-shaped reference patterns formed of slant lines, the reference patterns being provided in a matrix-like form on a substantially entire surface of the transport member;

a detecting unit that detects crossing points of said slant lines and detects the reference pattern being moved as the transport member is driven;

a calculating unit that calculates a speed change of the transport member and a position shift in a direction perpendicular to the transporting direction of the transport member based on detection information from the detecting unit; and an ink ejection control unit that both simultaneously controls output timing of ink droplets ejected from the plural ink ejection ports so as to correct for the influence of the speed change of the transport member based on a result of the calculation of the speed change of the transport member by the calculating unit and controls ejection positions of the ink droplets ejected from the plural ink ejection ports so as to correct for the influence of the position shift in the direction perpendicular to the transporting direction of the transport member based on a result of the calculation of the position shift in the direction perpendicular to the transporting direction of the transport member by the calculating unit;

the detecting unit including a reference pattern detecting sensor having a sensor surface including a plurality of optical sensors arranged along a widthwise direction of the reference pattern detecting sensor and having a width generally equal to that of the recording head, and the range of detection by the plurality of optical sensors is set to be wider than a width of the transport member, and the calculating unit providing real time correction of the influence of speed change and/or skew/walk of the transport member and the influence of the orientation of each sheet of recording medium so that high quality image recording can be achieved at an appropriate position on the recording medium.

2. The image recording apparatus according to claim 1, wherein:

the calculating unit calculates an inclination of the recording medium relative to the transport member based on detection information resulting from the detecting unit detecting the reference pattern of the transport member driven while supporting the recording medium thereon; and the ink ejection control unit controls ejection positions of the ink droplets ejected from the plural ink ejection portions so as to correct for the influence of the inclination of the recording medium relative to the transport member based on a result of the calculation of the inclination of the recording medium by the calculating unit.

3. The image recording apparatus according to claim 1, wherein the reference pattern is formed on the surface of the transport member by ink droplets ejected from the recording head.

4. The image recording apparatus according to claim 3, further comprising:

a cleaning unit that removes the reference pattern formed on the surface of the transport member thereby cleaning the surface of the transport member.

5. The image recording apparatus according to claim 1, further comprising:

a memory unit that stores a result of the calculation by the calculating unit.

6. An image recording apparatus wherein an image is recorded on a recording medium being transported, by ejecting ink droplets from plural ink ejection ports provided in a recording head, the apparatus comprising:

a transport member for transporting a recording medium supported on a surface thereof to an image forming position defined by the recording head;

a drive unit that drives the transport member in a transporting direction of the recording medium;

a reference pattern provided on the surface of the transport member, said reference pattern comprising a plurality of X-shaped reference patterns formed of slant lines, the reference patterns being provided in a matrix-like form on a substantially entire surface of the transport member;

a detecting unit that detects crossing points of said slant lines and detects the reference pattern being moved as the transport member is driven;

a calculating unit that both simultaneously calculates a speed change of the transport member and a position shift in a direction perpendicular to the transporting direction of the transport member based on detection information of the detecting unit;

a transport member drive control unit that controls the drive unit so as to suppress the speed change of the recording medium based on a result of the calculation of the speed change of the transport member by the calculating unit;

a correcting unit that corrects the position shift in the direction perpendicular to the transporting direction of the transport member which occurs as the transport member is driven; and a transport member correction control unit that controls the correcting unit so as to suppress the position shift in the direction perpendicular to the transporting direction of the transport member based on a result of the calculation of the position shift by the calculating unit;

the detecting unit including a reference pattern detecting sensor having a sensor surface including a plurality of optical sensors arranged along a widthwise direction of the reference pattern detecting sensor and having a width generally equal to that of the recording head, and the range of detection by the plurality of optical sensors is set to be wider than a width of the transport member, and the calculating unit providing real time correction of the influence of speed change and/or skew/walk of the transport member and the influence of the orientation of each sheet of recording medium so that high quality image recording can be achieved at an appropriate position on the recording medium.

7. The image recording apparatus according to claim 6, wherein:

the calculating unit calculates an inclination of the recording medium relative to the transport member based on detection information resulting from the detecting unit detecting the reference pattern of the transport member driven while supporting the recording medium thereon;

the image recording apparatus further comprising:

an ink ejection control unit that controls ejection positions of the ink droplets ejected from the plural ink ejection ports so as to correct for the influence of the inclination of the recording medium relative to the transport member based on a result of the calculation of the inclination of the recording medium by the calculating unit.

8. The image recording apparatus according to claim 6, wherein the reference pattern is formed on the surface of the transport member by ink droplets ejected from the recording head.

9. The image recording apparatus according to claim 8, further comprising:

a cleaning unit that removes the reference pattern formed on the surface of the transport member thereby cleaning the surface of the transport member.

10. The image recording apparatus according to claim 6, further comprising:

a memory unit that stores a result of the calculation by the calculating unit.

11. An image recording apparatus wherein an image is recorded on a recording medium being transported, by ejecting ink droplets from plural ink ejection ports provided in a recording head, the apparatus comprising:

a transport member for transporting a recording medium supported on a surface thereof to an image forming position defined by the recording head;

a drive unit that drives the transport member in a transporting direction of the recording medium;

a reference pattern provided on the surface of the transport member, said reference pattern comprising a plurality of X-shaped reference patterns formed of slant lines, the reference patterns being provided in a matrix-like form on a substantially entire surface of the transport member;

a detecting unit that detects crossing points of said slant lines and detects the reference pattern being moved as the transport member is driven;

a calculating unit that calculates a speed change of the transport member and a position shift in a direction perpendicular to the transporting direction of the transport member based on detection information from the detecting unit;

a memory unit that stores a result of the calculation by the calculating unit;

an ink ejection control unit that both simultaneously controls output timing of ink droplets ejected from the plural ink ejection ports so as to correct for the influence of the speed change of the transport member based on a result of the calculation of the speed change of the transport member by the calculating unit and controls ejection positions of the ink droplets ejected from the plural ink ejection ports so as to correct for the influence of the position shift in the direction perpendicular to the transporting direction of the transport member based on a result of the calculation of the position shift in the direction perpendicular to the transporting direction of the transport member by the calculating unit;

a transport member drive control unit that controls the drive unit so as to suppress the speed change of the recording medium based on a result of the calculation of the speed change of the transport member by the calculating unit;

a correcting unit that corrects the position shift in the direction perpendicular to the transporting direction of the transport member which occurs as the transport member is driven; and a transport member correction control unit that controls the correcting unit so as to suppress the position shift in the direction perpendicular to the transporting direction of the transport member based on a result of the calculation of the position shift by the calculating unit;

the detecting unit including a reference pattern detecting sensor having a sensor surface including a plurality of optical sensors arranged along a widthwise direction of the reference pattern detecting sensor and having a width generally equal to that of the recording head, and the range of detection by the plurality of optical sensors is set to be wider than a width of the transport member, and the calculating unit providing real time correction of the influence of speed change and/or skew/walk of the transport member and the influence of the orientation of each sheet of recording medium so that high quality image recording can be achieved at an appropriate position on the recording medium.

12. The image recording apparatus according to claim 11, wherein:

the calculating unit calculates an inclination of the recording medium relative to the transport member based on detection information resulting from the detecting unit detecting the reference pattern of the transport member driven while supporting the recording medium thereon; and the ink ejection control unit controls ejection positions of the ink droplets ejected from the plural ink ejection portions so as to correct for the influence of the inclination of the recording medium relative to the transport member based on a result of the calculation of the inclination of the recording medium by the calculating unit.

13. An image recording apparatus wherein an image is recorded on a recording medium being transported, by ejecting ink droplets from plural ink ejection ports provided in a recording head, the apparatus comprising:

a transport member for transporting a recording medium supported on a surface thereof to an image forming position defined by the recording head;

a drive unit that drives the transport member in a transporting direction of the recording medium;

a reference pattern provided on the surface of the transport member, the reference pattern comprising a plurality of X-shaped reference patterns formed of slant lines, the reference patterns being provided in a matrix-like form on a substantially entire surface of the transport member;

a detecting unit that detects crossing points of said slant lines and detects the reference pattern being moved as the transport member is driven, the detecting unit including a reference pattern detecting sensor having a sensor surface including a plurality of optical sensors arranged along a widthwise direction of the reference pattern detecting sensor and having a width generally equal to that of the recording head, and the range of detection by the plurality of optical sensors is set to be wider than a width of the transport member;

a calculating unit that calculates a speed change of the transport member and a position shift in a direction perpendicular to the transporting direction of the transport member based on detection information from the detecting unit;

the calculating unit determines the orientation of each sheet of recording medium relative to the transport member and calculates an inclination of the recording medium relative to the transport member based on detection information resulting from the detecting unit detecting the reference pattern of the transport member driven while supporting the recording medium thereon;

the calculating unit providing real time correction of the influence of speed change and/or skew/walk of the transport member and the influence of the orientation of each sheet of recording medium so that high quality image recording can be achieved at an appropriate position on the recording medium; and an ink ejection control unit that both simultaneously controls output timing of ink droplets ejected from the plural ink ejection ports so as to correct for the influence of the speed change of the transport member based on a result of the calculation of the speed change of the transport member by the calculating unit and controls ejection positions of the ink droplets ejected from the plural ink ejection ports so as to correct for the influence of the position shift in the direction perpendicular to the transporting direction of the transport member based on a result of the calculation of the position shift in the direction perpendicular to the transporting direction of the transport member by the calculating unit;

the ink ejection control unit controls ejection positions of the ink droplets ejected from the plural ink ejection portions so as to correct for the influence of the inclination of the recording medium relative to the transport member based on a result of the calculation of the inclination of the recording medium by the calculating unit.

* * * * *